US009709919B2

(12) United States Patent
Saitoh et al.

(10) Patent No.: US 9,709,919 B2
(45) Date of Patent: Jul. 18, 2017

(54) DEVELOPING DEVICE, IMAGE FORMING APPARATUS, AND PROCESS CARTRIDGE

(71) Applicants: Kazuya Saitoh, Kanagawa (JP); Hiroomi Tamura, Kanagawa (JP); Tetsuto Ueda, Kanagawa (JP); Sho Sekiguchi, Kanagawa (JP)

(72) Inventors: Kazuya Saitoh, Kanagawa (JP); Hiroomi Tamura, Kanagawa (JP); Tetsuto Ueda, Kanagawa (JP); Sho Sekiguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/719,649

(22) Filed: May 22, 2015

(65) Prior Publication Data

US 2015/0355572 A1 Dec. 10, 2015

(30) Foreign Application Priority Data

Jun. 5, 2014 (JP) ..... 2014-117047
Dec. 8, 2014 (JP) ..... 2014-247834

(51) Int. Cl.
*G03G 15/08* (2006.01)
*G03G 21/20* (2006.01)

(52) U.S. Cl.
CPC ..... *G03G 15/0824* (2013.01); *G03G 21/203* (2013.01)

(58) Field of Classification Search
None
See application file for complete search history.

(56) References Cited

U.S. PATENT DOCUMENTS 7,536,121 B2 5/2009 Shimizu et al.
7,697,854 B2 4/2010 Itoyama et al.
(Continued)

FOREIGN PATENT DOCUMENTS

JP 2006-208919 8/2006
JP 2007-171928 7/2007
(Continued)

OTHER PUBLICATIONS

U.S. Appl. No. 14/622,213, filed Feb. 13, 2015.

*Primary Examiner* — David M Gray
*Assistant Examiner* — Sevan A Aydin
(74) *Attorney, Agent, or Firm* — Oblon, McClelland, Maier & Neustadt, L.L.P.

(57) ABSTRACT

A developing device includes a casing containing a two-component developer including toner and carrier, a developer bearer to transfer the developer on the developer bearer to a developing area, a toner density sensor to output an output value based on toner density of the developer, a toner density detection module to detect the toner density based on the output value of the toner density sensor and output characteristics relating the toner density and the output value, an acquisition module to acquire the output characteristics based on the output value of the toner density sensor relating a new developer and a predetermined toner density of the new developer, a bulk density fluctuation estimating module to estimate bulk density fluctuation for bulk density of the new developer, and a correction module to correct the output value based on the estimated bulk density fluctuation.

18 Claims, 9 Drawing Sheets

(56) References Cited

U.S. PATENT DOCUMENTS

| | | | | |
|---|---|---|---|---|
| 8,095,042 | B2 | 1/2012 | Tamura | |
| 8,422,897 | B2 | 4/2013 | Suzuki et al. | |
| 2001/0036371 | A1* | 11/2001 | Ozawa | G03G 15/0853 399/53 |
| 2004/0184826 | A1* | 9/2004 | Ozawa | G03G 15/0853 399/30 |
| 2013/0156466 | A1 | 6/2013 | Bisaiji et al. | |
| 2013/0248562 | A1 | 9/2013 | Yoshida et al. | |
| 2014/0027012 | A1 | 1/2014 | Saitoh et al. | |
| 2015/0125186 | A1* | 5/2015 | Hirobe | G03G 15/0893 399/269 |
| 2015/0139668 | A1* | 5/2015 | Sugiyama | G03G 15/0266 399/12 |
| 2015/0177647 | A1* | 6/2015 | Noguchi | G03G 15/086 399/30 |

FOREIGN PATENT DOCUMENTS

| | | |
|---|---|---|
| JP | 2008-216816 | 9/2008 |
| JP | 2012-108483 | 6/2012 |
| JP | 2014-026175 | 2/2014 |

* cited by examiner

DEVELOPING DEVICE, IMAGE FORMING APPARATUS, AND PROCESS CARTRIDGE

BACKGROUND OF THE INVENTION

1. Field of the Invention

The disclosures discussed herein relate to a developing device, an image forming apparatus, and a process cartridge.

2. Description of the Related Art

There is known in the related art a developing device employing a two-component developer composed of toner and magnetic carrier as a developer so as to develop a latent image formed on a latent image bearer to form a visible image. In such a developing device, the two-component developer contained inside a casing is supplied to a developer bearer, and the developer bearer supplies toner contained in the two-component developer on the surface of the developer bearer to a latent image on a latent image bearer in a developing area facing the latent image bearer to visualize the latent image.

In the developing device employing the two-component developer, since the toner contained in the developer inside the casing is consumed by development, toner is supplied by a toner supply device. In order to maintain a developing ability of the developing device, toner needs to be appropriately supplied to the developer in the developing device such that a mixing ratio [wt %] of toner to magnetic carrier in the developer used for the development falls within a predetermined range. As an example of a toner density sensor to detect toner density of the developer, Japanese Laid-open Patent Publication No. 2012-108483 (hereinafter referred to as "Patent Document 1") discloses a technology to detect toner density utilizing magnetic permeability of the developer that varies with the toner density. In the output of the toner density sensor utilizing the magnetic permeability change of the developer, when the toner density is low, the carrier charge near the toner density sensor increases to raise the magnetic permeability of the developer, thereby increasing an output value of the toner density sensor. By contrast, when the toner density is high, the carrier charge near the toner density sensor decreases to lower the magnetic permeability of the developer, thereby decreasing the output value of the toner density sensor. Hence, the toner density is detected based on the output value of the toner density sensor, and output characteristics indicating a relationship between the output value of the toner density sensor and toner density.

In the technology disclosed, for example, in Patent Document 1, when the developer is stirred at a stirring speed other than the standard stirring speed, the output value of the toner density sensor is corrected to obtain the output characteristics (the relationship between the output value of the toner density sensor and toner density) when the developer is stirred at the standard stirring speed.

The bulk density of the developer fluctuates with the carrier charge. That is, when the carrier charge is low, electrostatic repulsive force between carrier particles is reduced. Hence, particles of the developer become more tightly packed to increase the bulk density. On the other hand, when the carrier charge is high, electrostatic repulsive force between carrier particles is raised. Hence, the bulk density of the developer is lowered. The carrier charge may, for example, fluctuate with humidity. The carrier is more susceptible to charge, and the carrier charge increases as the humidity decreases.

The disclosed related art technology handles the output characteristics at the standard stirring speed as an unchangeable factor, and hence, uses predetermined output characteristics. However, the susceptibility of the carrier to being charged may vary, for example, with humidity. Hence, at the standard stirring speed, the developers having the same toner density may have different bulk densities due to conditions such as humidity. That is, the output characteristics at the standard stirring speed may vary with humidity. Hence, in the related art technology, the toner density at the standard stirring speed obtained based on the predetermined output characteristics and the output value of the toner density sensor may differ from the actual toner density due to the conditions such as the environment. Accordingly, the related art technology may fail to detect the accurate toner density due to the environment and the like at the standard stirring speed. As a result, the density of toner in the developer inside the casing may fail to be controlled, thereby obtaining image density failure.

RELATED ART DOCUMENT

Patent Document

Patent Document 1: Japanese Laid-open Patent Publication No. 2012-108483

SUMMARY OF THE INVENTION

Accordingly, it is a general object in one embodiment of the present invention to provide a developing device capable of accurately detecting the density of toner of a developer inside a casing, and maintaining the density of toner in the developer inside the casing at a predetermined density, a process cartridge provided with the developing device, and an image forming apparatus that substantially obviate one or more problems caused by the limitations and disadvantages of the related art.

According to an aspect of embodiments, there is disclosed a developing device that includes a casing containing a two-component developer including toner and carrier; a developer bearer configured to carry the two-component developer on a surface of the developer bearer to transfer the two-component developer to a developing area facing a latent image bearer; a toner density sensor configured to output an output value in accordance with toner density of the two-component developer inside the casing; a toner density detection module configured to detect toner density based on the output value of the toner density sensor and output characteristics that relate toner density and the output value; an acquisition module configured to acquire the output characteristics based on the output value of the toner density sensor associated with a new developer inside the casing and a predetermined toner density of the new developer; a bulk density fluctuation estimating module configured to estimate bulk density fluctuation with respect to bulk density of the new developer, the bulk density being expected to be obtained when a current developer has the predetermined toner density; and a correction module configured to correct the output value of the toner density detection module based on the bulk density fluctuation estimated by the bulk density fluctuation estimating module.

Other objects, features and advantages of the present invention will become more apparent from the following detailed description when read in conjunction with the accompanying drawings.

DETAILED DESCRIPTION OF THE PREFERRED EMBODIMENTS

Figure 1:
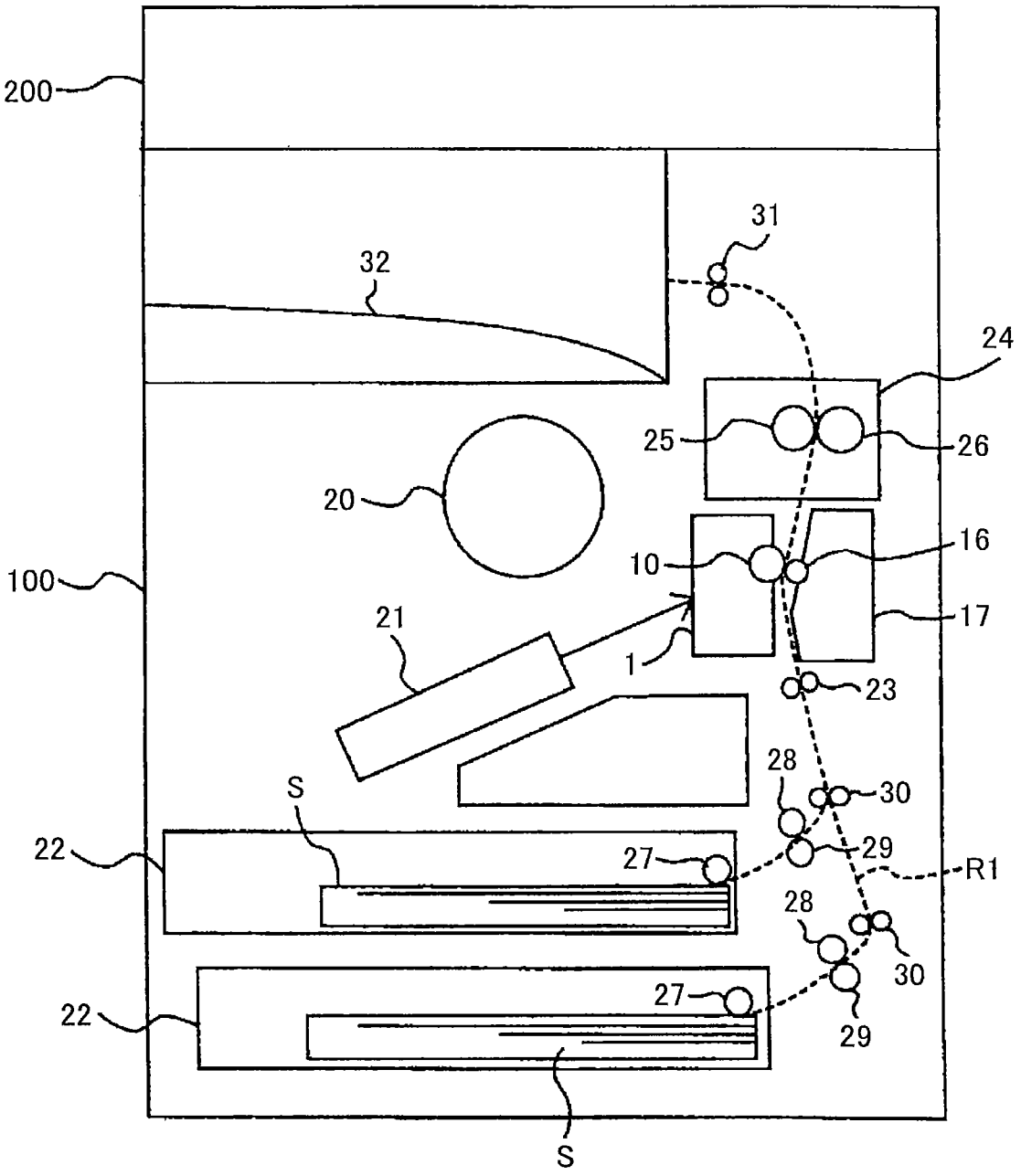
FIG. 1 is a schematic diagram illustrating an image forming apparatus.

FIG. 1 is a schematic diagram illustrating an image forming apparatus according to an embodiment. A copier serving as the image forming apparatus includes an apparatus main body 100, and an image reading device 200 disposed above the apparatus main body 100.

Figure 2A:
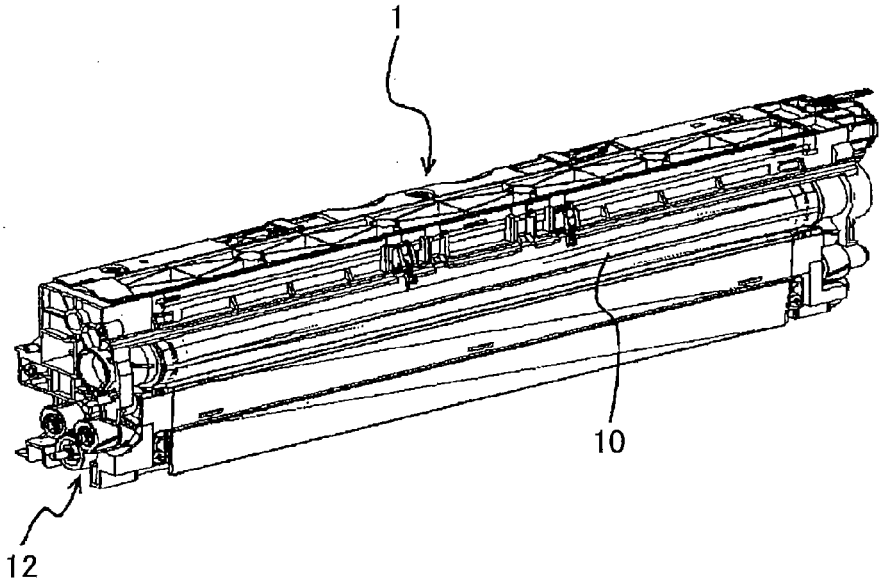
FIG. 2A is a perspective diagram illustrating a process cartridge.
Figure 2B:
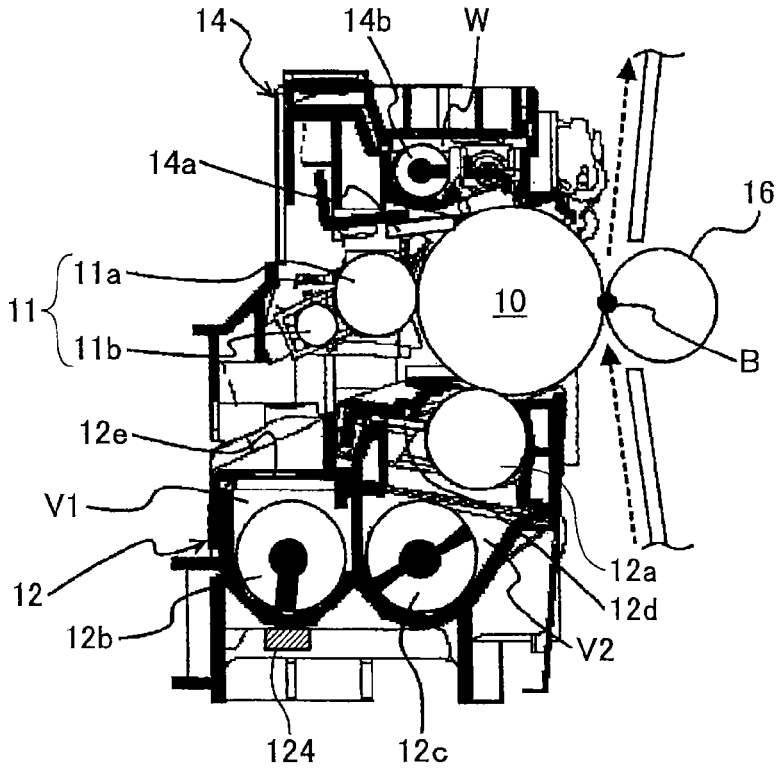
FIG. 2B is a cross-sectional diagram of the process cartridge.

The apparatus main body 100 includes a process cartridge 1. FIG. 2A is a perspective diagram of the process cartridge 1, and FIG. 2B is a cross-sectional diagram of the process cartridge 1. As illustrated in FIG. 2B, the process cartridge 1 includes a photoconductor 10 serving as a latent image bearer, a charging device 11 serving as a process module disposed around the photoconductor 10, a developing device 12, and a cleaning device 14. The process cartridge 1 is detachably attached to the apparatus main body 100. Replacement work or maintenance work may be simplified by integrating the photoconductor 10, the charging device 11, the developing device 12, and the cleaning device 14 to form a unit of the process cartridge 1. Further, high accuracy in location between the components may be maintained so that the quality of images to be formed may be improved.

The charging device 11 serving as a charging module includes a charging roller 11*a* configured to receive a charging bias, and apply charges to a surface of the photoconductor 10 to uniformly charge the photoconductor 10, and a removing roller 11*b* configured to remove adhered substances that are adhered to a surface of the charging roller 11*a*.

The developing device 12 serving as a developing module includes a first agent container V1 having a first transfer screw 12*b* serving as a (first) developer transfer module. The developing device 12 further includes a second agent container V2 having a second transfer screw 12*c* serving as a (second) developer transfer module, a developing roller 12*a* serving as a developer bearer, and a doctor blade 12*d* serving as a developer regulating member.

Figure 9:
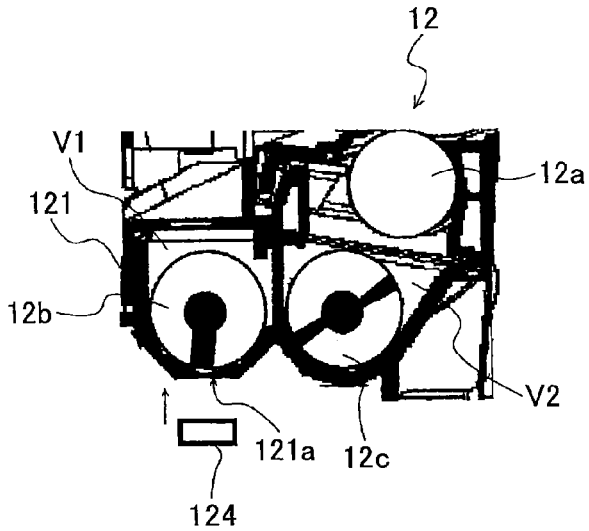
FIG. 9 is a diagram illustrating a mode in which the toner density sensor is attached to the developing device.

The first and the second agent containers V1 and V2 contain a developer, more specifically, a two-component developer composed of a magnetic carrier and negatively charged toner. The first transfer screw 12*b* is rotationally driven by a drive module to transfer the developer in the first agent container V1 to a front side of the first agent container V1 in the figure (FIG. 9). The developer carried by the first transfer screw 12*b* to the front side of the first agent container V1 in the figure is then introduced into the second agent container V2.

The second transfer screw 12*c* in the second agent container V2 is rotationally driven by the drive module to transfer the developer to a back side of the second agent container V2 in the figure (FIG. 9). The developing roller 12*a* is disposed above the second transfer screw 12*c* such that the developing roller 12*a* is oriented in parallel with the second transfer screw 12*c*. The developing roller 12*a* is configured to include a magnetic roller fixed inside a developing sleeve composed of a rotationally driven non-magnetic sleeve.

Part of the developer carried by the second transfer screw 12*c* is scooped on a surface of the developing roller 12*a* by the magnetic force generated by the magnetic roller inside the developing roller 12*a*. The thickness of the scooped developer on the surface of the developing roller 12*a* is regulated by the doctor blade 12*d* configured to maintain a predetermined interval between the surface of the developing roller 12*a* and the doctor blade 12*d*. The developer is then carried to a developing area facing the photoconductor 10, where toner is attached to an electrostatic latent image formed on the photoconductor 10. Consequently, a toner image is formed on the photoconductor 10 by the attachment of toner. The developer that has lost toner due to the development is returned above the second transfer screw 12*c* along with traveling on the surface of the developing roller 12*a*. The developer carried by the second transfer screw 12*c* to an end of the second agent container V2 is then returned into the first agent container V1. The developer circulates inside the developing device as described above.

The developing device 12 further includes a toner density sensor 124 serving as a toner density detecting module configured to detect the density of toner of the developer in the first agent container V1. The toner density sensor 124 is configured to measure the toner density of the developer based on magnetic permeability of the developer. When a value measured by the toner density sensor 124 exceeds a target value (a threshold), toner is supplied from a toner bottle 20 serving as a toner container illustrated in FIG. 1 so that the toner density is controlled at a predetermined density. The target value is determined based on a detected result obtained by an optical sensor, which detects an amount of toner adhered to a toner pattern formed on the photoconductor 10.

The toner density is maintained at a predetermined standard pattern density on the photoconductor by the above-described operations; however, degradation in the toner density may be uncontrollable when the toner in the toner bottle 20 has run out. In such a case, the detected result of the density of the toner pattern obtained by the optical sensor may fail to be improved in a predetermined period despite the fact that operations to supply toner from the toner bottle 20 are carried out. Hence, when the detected result of the toner pattern is not improved despite the operations to supply toner from the toner bottle 20, the detected result is determined (estimated) to indicate that toner has run out (toner end).

After the detected result is determined to indicate the toner end, the toner bottle 20 will be replaced with a new one. To recover from the toner end by supplying toner from a replacement (new) toner bottle 20 into the developing device 12, the following operations may be carried out. That is, in order to mix the developer with supplied toner reasonably well, the developing roller 12*a*, and the first and second transfer screws 12*b* and 12*c* are rotated. At this time, the photoconductor 10 is also driven to rotate in order to prevent the developer on the developing roller 12*a* from sliding non-uniformly.

The cleaning device 14 serving as a cleaning module includes a cleaning blade 14*a* configured to scrape transferred residual toner adhered to the surface of the photoconductor 10. The cleaning device 14 further includes a toner collecting coil 14*b* configured to transfer the toner collected from the cleaning blade 14*a* to be placed in a collecting part W. The collected toner carried by the toner collecting coil 14*b* is carried in the developing device 12 or a waste toner bottle 41 by a later-described toner transfer device 50.

The transfer device 17 serving as a transfer module illustrated in FIG. 1 includes a transfer roller 16 configured to be pressed on a peripheral surface of the photoconductor 10. Further, a thermal fixing device 24 serving as a fixing module is disposed above the transfer device 17. The thermal fixing device 24 includes a heating roller 25 and a pressure roller 26. Further, the apparatus main body 100 is provided with a laser writing device 21 serving as a latent image forming module. The laser writing device 21 includes a laser light source, a rotary polygon mirror for scanning, a polygon motor, an fθ lens, and the like. The apparatus main body 100 further included a sheet cassette 22 having multiple stages for storing sheets S such as transfer sheets and OHP films.

To copy a document or the like with such an apparatus having the above configuration, a user initially depresses a start switch. The depression of the start switch causes the image reading device 200 to read content of the document set in the image reading device 200. Simultaneously, the photoconductor drive motor drives the photoconductor 10 to rotate so that the charging device 11 having the charging roller 11*a* uniformly charges the surface of the photoconductor 10. Subsequently, the laser writing device 21 executes a writing process by emitting laser light based on the content of the document read by the image reading device 200. After an electrostatic latent image is formed on the surface of the photoconductor 10, toner is adhered to the electrostatic latent image by the developing device 12 to form a visible image (developed).

Further, sheets S selected from the multiple stage sheet cassette 22 are fed by a calling roller 27 simultaneously with the user's depression of the start switch. Subsequently, each of the sheets S is separated by a supply roller 28 and a separate roller 29, and is then transferred in a supply path R1. The sheet S transferred in the supply path R1 is carried by a sheet transfer roller 30, and the carried sheet S then hits a registration roller 23 to be stopped. The sheet S is then transferred into a transfer nip between the transfer roller 16 and the photoconductor 10 by matching rotational timing of the visible toner image formed on the photoconductor 10.

The transfer device 17 then transfers the toner image from the photoconductor 10 onto the sheet S transferred into the transfer nip. The residual toner on the photoconductor 10 after the transfer of the image is removed by the cleaning device 14. A destaticizing device removes a residual potential of the photoconductor 10 from which the residual toner has been removed. The image forming apparatus is then in a standby mode for forming a next image, starting from the charging device 11.

Meanwhile, the sheet S on which the image has been transferred is led to the thermal fixing device 24. The sheet S is then transferred between the heating roller 25 and the pressure roller 26 where the toner image is fixed on the sheet S while being transferred by the heating roller 25 and the pressure roller 26. The sheet S on which the image is fixed is then ejected by a paper ejection roller 31, and the ejected sheet S is then stacked on an ejected paper stack part 32.

Figure 3:
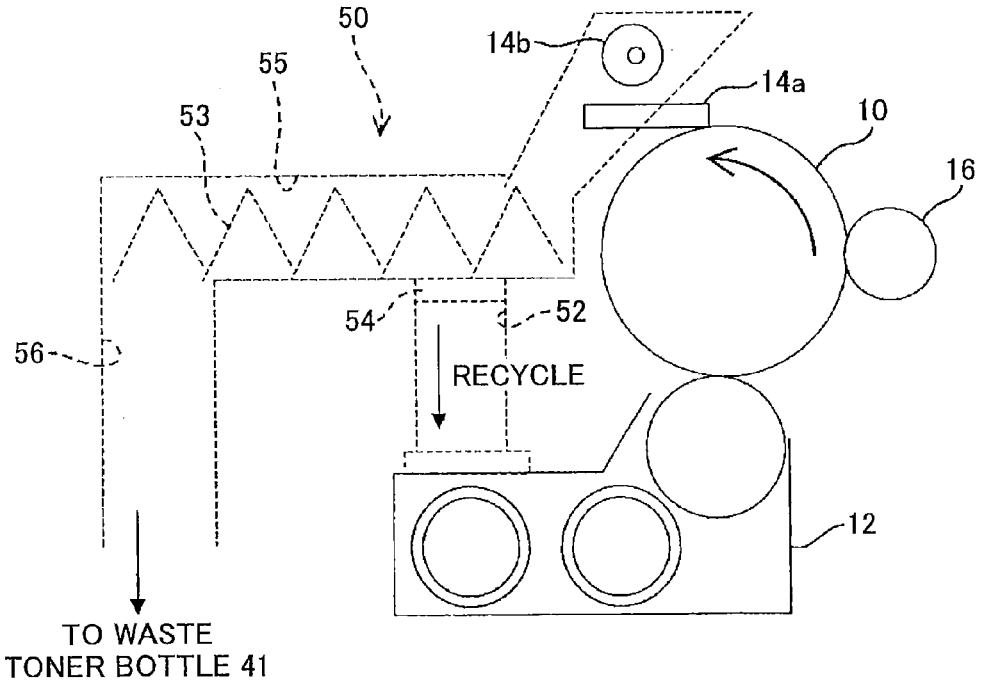
FIG. 3 is an explanatory diagram illustrating transfer of toner collected by a cleaning device 14.

In this embodiment, the toner collected by the cleaning device 14 is selectively transferred to one of the developing device 12 and the waster toner bottle 41 (see FIG. 3). FIG. 3 is an explanatory diagram illustrating the transfer of the toner collected by the cleaning device 14. As illustrated in FIG. 3, the toner collected by the cleaning device 14 is transferred by the toner collecting coil 14*b* to an upstream end in a collected toner transfer direction of a collected toner transfer path 55 of a toner transfer device 50. A waste toner communication path 56 is connected to a downstream end in the collected toner transfer direction of the collected toner transfer path 55. The waste toner communication path 56 is configured to allow the collected toner to fall in the waste toner bottle 41. Further, a collected toner supply path 52 is connected to the collected toner transfer path 55. The collected toner supply path 52 is configured to supply the collected toner in the development device 12. Moreover, a shutter member 54 is provided between the collected toner transfer path 55 and the collected toner supply path 52 to open or close an interval between the collected toner transfer path 55 and the collected toner supply path 52.

When the collected toner transferred to the collected toner transfer path 55 is transferred to the waste toner bottle 41, the shutter member 54 closes a connecting part between the collected toner supply path 52 and the collected toner transfer path 55. Hence, in this case, the collected toner inside the collected toner transfer path 55 is moved to the downstream end of the collected toner transfer path 55 by a collected toner transfer coil 53 inside the collected toner transfer path 55. The collected toner spontaneously falls inside the waste toner communication path 56 to travel to the waste toner bottle 41.

Meanwhile, when the collected toner is to be reused (recycled), the shutter member 54 is retracted from the connecting part between the collected toner supply path 52 and the collected toner transfer path 55. As a result, the collected toner inside the collected toner transfer path 55 falls into the collected toner supply path 52 while the collected toner is moved by the collected toner transfer coil 53 toward the waste toner communication path 56. The collected toner is then supplied from a toner supply port 12*e* of the developing device 12 into the developing device 12.

Figure 4:
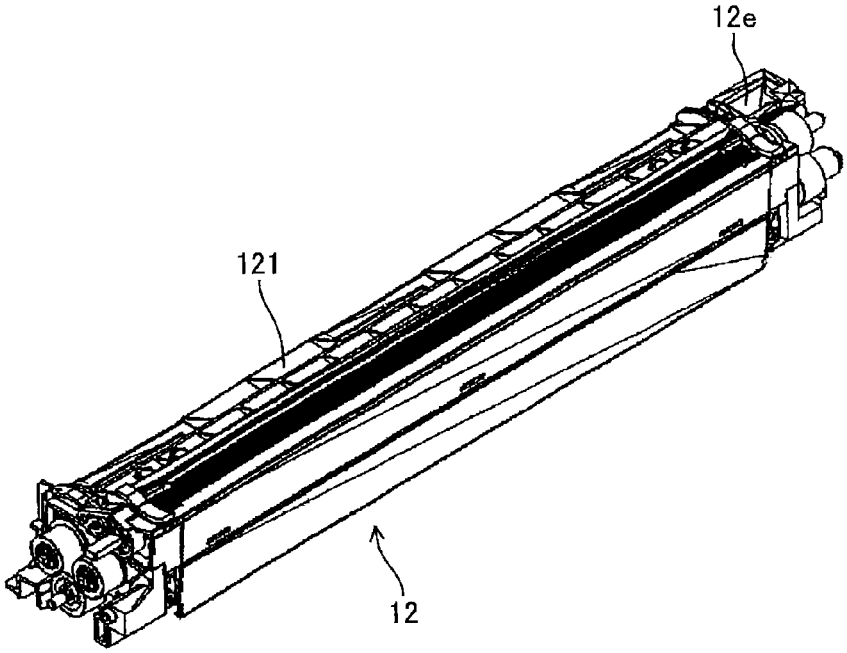
FIG. 4 is a perspective diagram illustrating the appearance of a developing device.
Figure 5:
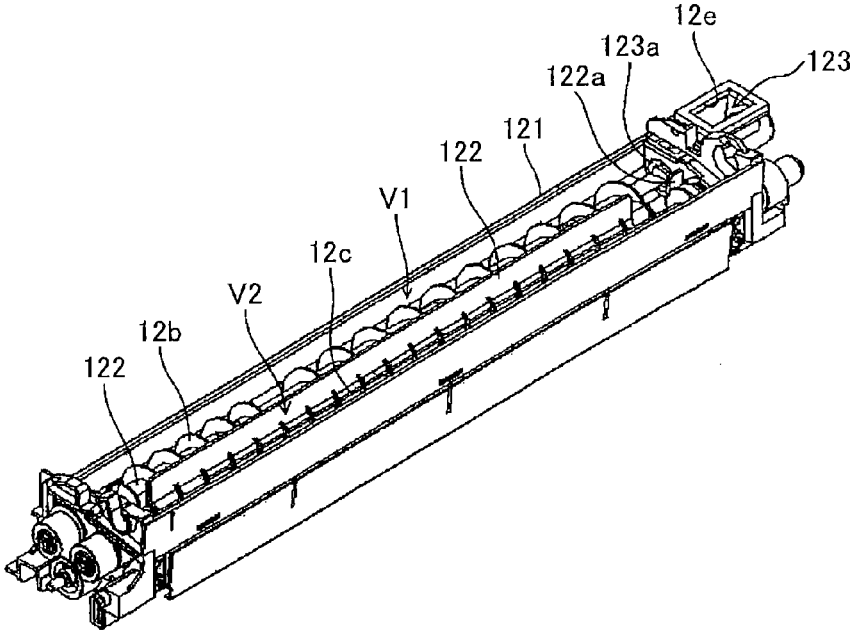
FIG. 5 is a perspective diagram illustrating the developing device from which an upper casing and a developing roller are removed so as to observe inside a developer container of the developing device.
Figure 6:
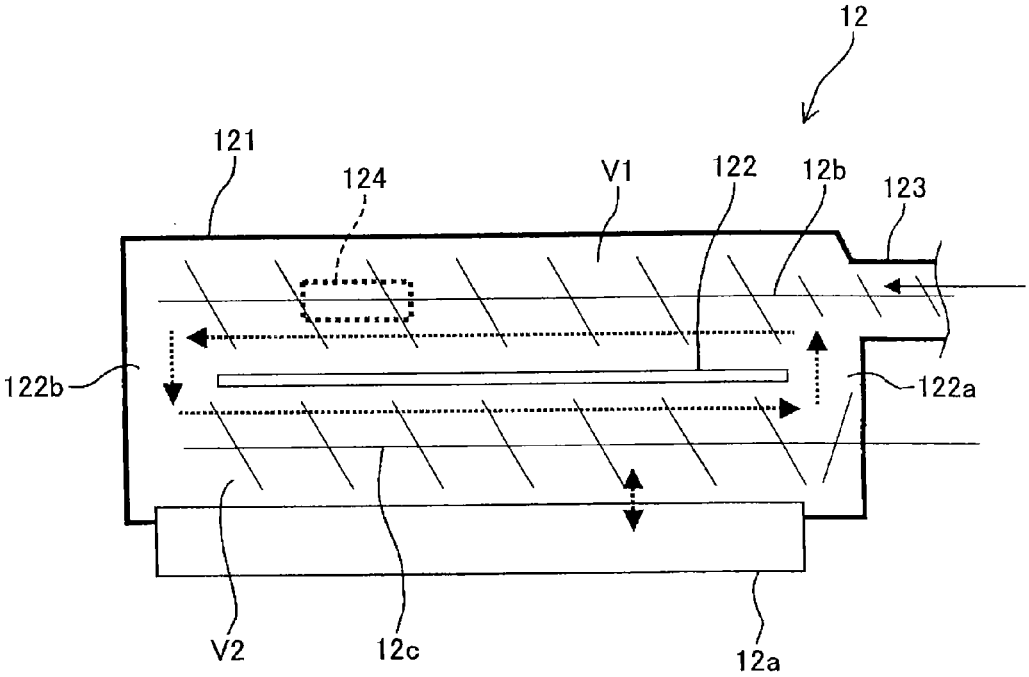
FIG. 6 is a schematic diagram illustrating a circulation path of a developer inside the developing device.

Next, a further detailed illustration is given of a configuration and operations of the developing device 12. FIG. 4 is a perspective diagram illustrating an example appearance of the developing device 12. FIG. 5 is a perspective diagram illustrating the developing device 12 from which an upper casing and the developing roller 12*a* are removed so as to observe inside the developer container of the developing device 12. FIG. 6 is a schematic diagram illustrating a circulating path of the developer inside the developing device 12. In FIG. 6, dotted arrows indicate flows of the developer, and a solid arrow indicates a flow of toner supplied from a toner supply port 12*e* (see FIG. 2B).

The developer container is composed of a developing casing 121 inside the developing device 12. The developer container includes a partition 122 to partition the developer container into the first agent container V1 and the second agent container V2. The first agent container V1 is provided with the first transfer screw 12*b*, and the second agent container V2 is provided with the second transfer screw 12*c*. The first agent container V1 and the second agent container V2 are configured to communicate with each other via delivery openings 122*a* and 122*b* disposed at opposite ends in a longitudinal direction of the partition 122.

The developer transferred by the second transfer screw 12*c* to the downstream end of the second agent container V2 passes through the delivery opening 122*a* at the end of the partition 122 to move into the first agent container V1. The developer inside the first agent container V1 that is stirred by the first transfer screw 12*b* is transferred in a direction opposite to a direction of the developer transferred inside the second agent container V2. The developer that has reached the downstream end in the transfer direction of the first agent container V1 passes through the delivery opening 122*b* at the end of the partition 122 to move into the second agent container V2. The developer is circulated by the transfer screws 12*b* and 12*c* provided in the first agent container V1 and the second agent container V2, respectively, partitioned by the partition 122 inside the developer casing 121.

Further, a supply toner transfer path 123 is coupled to the upstream end in the toner transfer direction of the first agent container V1. The supply toner transfer path 123 is provided with the toner supply port 12*e*, via which new toner, or collected toner collected by the cleaning device 14 is supplied. The first transfer screw 12*b* disposed in the first agent container V1 is extended to the supply toner transfer path 123. The toner supplied via the toner supply port 12*e* is transferred by the first transfer screw 12*b* inside the supply toner transfer path 123, subsequently passes through a communication hole 123*a* (see FIG. 5) configured to communicate between the first agent container V1 and the supply toner transfer path 231, is then transferred into the first agent container V1. Further, a reference number 124 in FIG. 6 indicates a toner density sensor configured to detect toner density of the developer. The toner density sensor 124 is disposed beneath the first agent container V1 of the developing casing 121.

Figure 7:
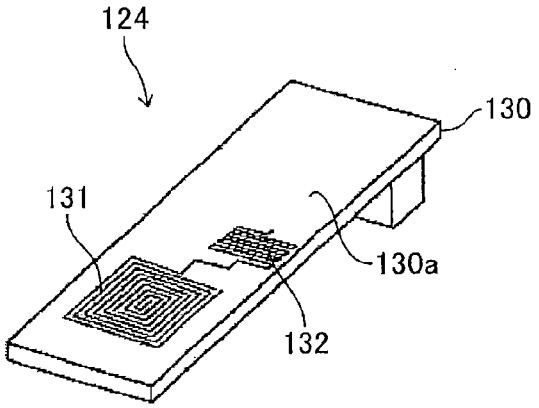
FIG. 7 is a perspective diagram illustrating a toner density sensor.

FIG. 7 is a perspective diagram illustrating the toner density sensor 124. In this embodiment, a magnetic permeability sensor configured to detect magnetic permeability of the developer is used as the toner density sensor 124. The toner density sensor 124 includes a substrate 130 having a detection surface 130*a*, and a planar pattern coil 131 and a pattern resistor 132 are formed on the detection surface 130*a* serving as an upper surface of the substrate 130. The pattern resistor 132 that is patterned on the detection surface 130*a* is connected in series with the planer pattern coil 131. The planer pattern coil 131 is a spiral signal wiring pattern formed in a plane. Further, the pattern resistor 132 is a zigzag folded signal pattern formed in a plane. Hence, a function to detect the magnetic permeability of the developer may be implemented by these two patterns.

Figure 8:
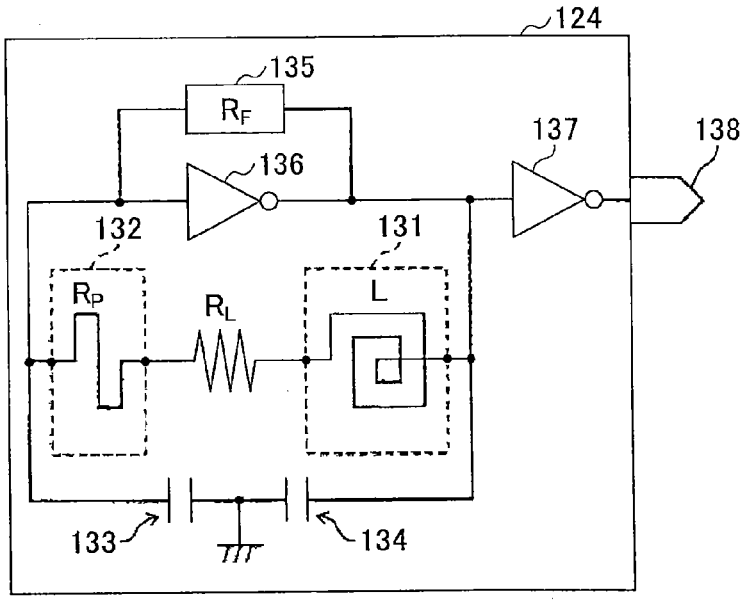
FIG. 8 is a block diagram illustrating an internal configuration of the toner density sensor.

FIG. 8 is a block diagram illustrating an internal configuration of the toner density sensor 124. As illustrated in FIG. 8, the toner density sensor 124 is an oscillator based on a Colpitts LC oscillator, so that the toner density sensor 124 includes a first capacitor 133 and a second capacitor 134 in addition to the above-described planer pattern coil 131, the pattern resistor 132. The toner density sensor 124 further includes a feedback resistor 135, unbuffered ICs 136 and 137, and an output terminal 138.

The planer pattern coil 131 that is composed of the signal wiring patterned in the plane on the substrate 130 includes inductance L. The value of the inductance L of the planer pattern coil 131 changes based on the magnetic permeability in space opposed to the plane in which the coil is formed. As a result, the toner density sensor 124 oscillates a signal having a frequency corresponding to the permeability in the space opposed to the coil surface of the planer pattern coil 131.

The pattern resistor 132, which is composed of the signal wiring patterned on the substrate in a manner similar to the planer pattern coil 131, has a folded zigzag pattern to inhibit current flow greater than the current flow in a linear pattern. As illustrated in FIG. 8, the planer pattern coil 131 and the pattern resistor 132 are connected in series.

The first capacitor 133 and the second capacitor 134 both have capacitance to form the planer pattern coil 131 and a Colpitts LC oscillator. Hence, in the first capacitor 133 and the second capacitor 134, the planer pattern coil 131 and the pattern resistor 132 are connected in series. A resonance current loop may be formed of a loop composed of the planer pattern coil 131 and the pattern resistor 132, the first capacitor 133 and the second capacitor 134.

The feedback resistor 135 is inserted for stabilizing a bias voltage. The functions of the unbuffered IC 136 and unbuffered IC 137 may allow fluctuation in part of the potential of the resonance current loop to be output from the output terminal 138 as a rectangular wave based on a resonance frequency. In such a configuration, the toner density sensor 124 oscillates at a frequency based on the inductance L, the resistance value $R_P$, and electrostatic capacitances C of the first capacitor 133 and the second capacitor 134.

Hence, the inductance L may change according to magnetic substance near the planer pattern coil 131 or its density. Accordingly, it is possible to determine the magnetic permeability in space near the planer pattern coil 131 based on the oscillation frequency of the toner density sensor 124.

Note that in this embodiment, the toner density sensor 124 is configured to oscillate at a frequency according to the magnetic permeability; however, the toner density sensor 124 may be configured to output a voltage according to the magnetic permeability.

FIG. 9 is a diagram illustrating a mode in which the toner density sensor 124 is attached to the developing device 12. As illustrated in FIG. 9, a sensor attachment member 121*a* via which the toner density sensor 124 is attached is formed on an outer peripheral surface of the developing casing 121. The sensor attachment member 121*a* is formed on an outer surface of a bottom wall of the first agent container V1. The sensor attachment member 121*a* is formed in a plane shape, and the detection surface 130*a* of the substrate of the toner density sensor 124 is attached so that the detection surface 130*a* faces the plane of the sensor attachment member 121*a*.

As illustrated in FIG. 9, the outer periphery surface of the developing casing 121 is formed based on the first and the second transfer screws 12*b* and 12*c*. Hence, the bottom wall of the first agent container V1 excluding the sensor attachment member 121*a* has an arc shape matching a circle forming a cross-section of the first transfer screw 12*b*. Then, the sensor attachment member 121*a* is molded in a plane shape. Accordingly, the thickness of the sensor attachment member 121*a* of the bottom wall of the first agent container V1 is less than those of other parts. In this configuration, it is possible to reduce a distance between the detection surface 130*a* of the toner density sensor 124 attached to the sensor attachment member 121*a* and the developer in the first agent container V1. As a result, the toner density sensor 124 may be able to detect appropriate magnetic permeability in the first agent container V1.

Figure 10:
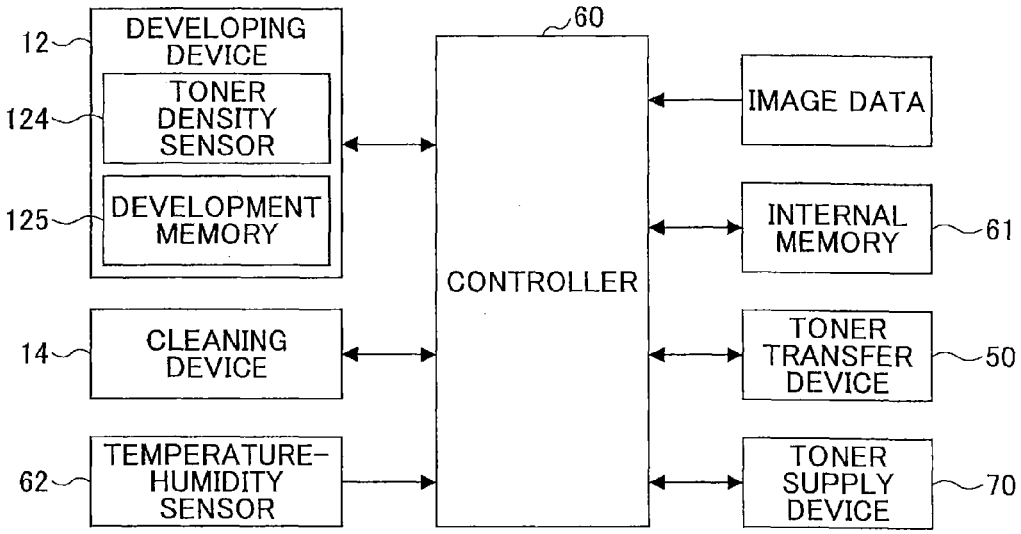
FIG. 10 is a block diagram illustrating a part of electronic circuits of a printer according to an embodiment.

FIG. 10 is a block diagram illustrating a part of electronic circuits of a printer according to an embodiment. In FIG. 10, a controller 60 serving as a control module includes a central processing unit (CPU) serving as an operation module. The controller 60 further includes a storage module such as a random access memory (RAM) and a read only memory. The controller 60 configured to control an overall apparatus may be connected with various kinds of devices or sensors; however, FIG. 10 illustrates only main devices or sensors connected to the controller 60 used for the collected toner supply control.

The controller 60 is configured to control each of the modules based on a control program stored in the RAM and ROM. For example, the controller 60 calculates an image area ratio from image data based on a predetermined control program, and controls the shutter member 54 to open or close based on the calculated image area ratio. Further, the controller 60 performs image density control at predetermined timing such as upon the supply of power or after the formation of images on a predetermined number of sheets. The image density control is performed by forming a toner pattern on the photoconductor 10, and detecting the amount of adherent toner of the toner pattern using an optical sensor. The image density control indicates adjusting a target value of the toner density (i.e., a target value of the output value of the toner density sensor) based on the detected result obtained by the optical sensor. Further, the controller 60 corrects an output value Vt of the toner density sensor 124 based on a detected result of the temperature-humidity sensor 62 or the like, as described later.

In the developing device utilizing a two-component developer composed of toner and magnetic carrier, toner of the developer inside the developing casing is consumed by development, which fluctuates toner density of the developer inside the developing casing. When the toner density inside the developing casing fluctuates, the magnetic permeability in space facing the sensor attachment member 121*a* will change. As a result, the oscillation frequency of the toner density sensor 124 changes, enabling the toner density sensor 124 to detect toner density inside the developing casing. Specifically, the controller 60 counts oscillation signals from the toner density sensor 124 to obtain an oscillation frequency of the toner density sensor 124 based on the counted value at a predetermined time, and acquires an output value Vt of the toner density sensor 124 based on the obtained oscillation frequency. The output value Vt of the toner density sensor 124 may be obtained by the following formula.

$$Vt=\alpha\times[\mu(\text{current value})-\mu(\text{initial value})]+Vt(\text{shift}) \quad (1)$$

μ(current value): current oscillation frequency (oscillation signal counted value)

μ(current value): oscillation frequency upon detection of initial developer (oscillation signal counted value)

Vt (shift): output value corresponding to toner density of initial developer

α: conversion coefficient

Note that the initial developer indicates a new developer having the toner and carrier charged up to a predetermined charge level to be ready for use.

The controller 60 obtains the toner density of the developer based on the output value Vt of the toner computed by the above formula (1), and characteristic data indicating a relationship between the toner density and the output value Vt of the toner density sensor stored in advance in memory of the controller 60.

Further, the controller 60 acquires output characteristics of the toner density sensor 124 when the developer inside the developing device is replaced with a new one, or the developing device is replaced with a developing device 12 containing a new developer. When the developer is replaced with a new one, or the developing device is replaced with a developing device 12 containing a new developer, the controller 60 may execute an initial replacement operation mode. The initial replacement operation mode may be executed, for example, by a service person who operates an operations panel. Further, information (e.g., flag) indicating the developing device containing a new developer may be stored in a development memory 125 serving as a nonvolatile storage module provided with the developing device 12. When such a developing device is attached to an image forming apparatus, the controller 60 performs communication with the development memory 125 to verify whether there is information indicating the developing device containing a new developer. When there is such information indicating the developing device containing a new developer, the initial replacement operation mode is executed.

When the initial replacement operation mode is executed, the new developer inside the developing device is stirred and transferred at a predetermined speed for a predetermined time, and toner and carrier inside the developing device are frictionally charged up to a predetermined charge level so that the toner and carrier inside the developing device are ready for use as an initial developer. During stirring and transferring operations, the controller 60 acquires, as p (an initial value), an oscillation frequency (oscillation signal counted value) of the toner density sensor 124. Subsequently, the controller 60 matches a relationship between the toner density and the output value Vt of the toner density sensor 124 with the characteristics data stored in the controller 60, based on the acquired p (initial value), the Vt (shift) stored in advance in the internal memory, and a conversion coefficient α. The output characteristics of the toner density sensor 124 are thus obtained.

Figure 11:
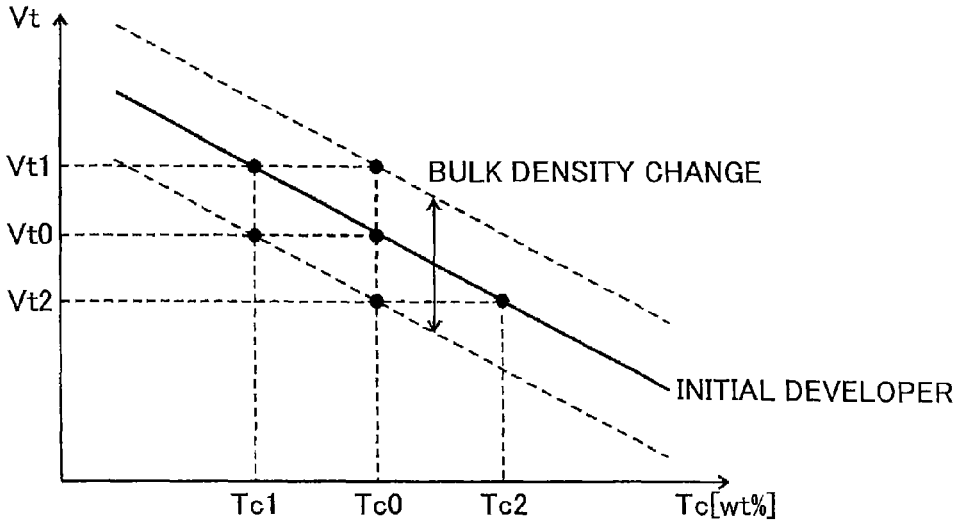
FIG. 11 is a diagram illustrating a relationship between toner density and an output value of the toner density sensor.

However, even though toner has the same toner density, the magnetic permeability may be changed by the change in bulk density of the developer inside the developing casing. As a result, the relationship between the toner density and the output value Vt of the toner density sensor 124 do not match the characteristics data. When the bulk density of the developer is increased, a volume ratio of the carrier in the developer is increased due to decreases in gaps between particles of the toner or carrier composing the developer. As a result, as illustrated in FIG. 11, the magnetic permeability is increased. Specifically, even though the toner density is Tc0, the output value of the toner density sensor 124 is Vt1, which is greater than Vt0. Accordingly, the toner density computed based on the characteristics data indicating the relationship between the toner density represented by a solid line in FIG. 11 and the output value Vt of the toner density sensor 124 stored in the controller 60 and the output value Vt1 of the toner density sensor may be Tc1, which is lower than the actual toner density Tc0. In such a case, the controller 60 controls the toner supply device 70 to supply toner to the developing device 12 until the output value of the toner density sensor reaches Vt0. As a result, the toner density inside the developing device may become higher than a target toner density.

On the other hand, when the bulk density of the developer is decreased, the volume ratio of the carrier in the developer is decreased due to increases in gaps between particles of the toner or carrier composing the developer. As a result, even though the toner is the same, and the toner density is the same Tc0, the output value of the toner density sensor is Vt2, which is less than Vt0. Accordingly, the toner density computed based on the characteristics data indicating the relationship between the toner density represented by a solid line in FIG. 11 and the output value Vt of the toner density sensor 124 stored in the controller 60 and the output value Vt1 of the toner density sensor may be Tc2, which is higher than the actual toner density Tc0. In such a case, the controller 60 controls the toner supply device 70 not to supply toner to the developing device 12 until the output value of the toner density sensor reaches Vt0. As a result, the toner density inside the developing device may become lower than the predetermined toner density.

When the toner density inside the developing casing becomes extremely high or extremely low, the image quality may be degraded or malfunction due to the development of the carrier in the developer may be observed. Hence, upper and lower limits are generally set in the target value of the toner density so as to prevent the target value of the toner density from having a value of developing the carrier in the developer to cause the malfunction.

As described above, the target value of the toner density is determined based on a detected result obtained by the optical sensor, which detects an amount of adherent toner of the toner pattern formed on the photoconductor 10. This target value of the toner density is set by the output value Vt of the toner density sensor 124. When the output value (target value) of the toner density sensor 124 determined based on the detected result obtained by the optical sensor exceeds one of the upper limit value and the lower limit value, the output value (target value) of the toner density sensor 124 is set to a corresponding one of the upper limit value and the lower limit value.

However, when the toner density sensor 124 fails to accurately detect the toner density due the fluctuation in the bulk density inside the developing device, the toner density inside the developing casing may be lower than or higher than the target toner density. Hence, the bulk density changes when the target value is controlled at the lower limit value (the target toner density is controlled at the upper limit). As a result, there may be a case where the output value of the toner density sensor has not reached the lower limit value despite the toner density reaching the upper limit. In such a case, toner is further supplied so as to cause the output value of the toner density sensor to reach the lower limit value. As a result, the toner density may be extremely high, allowing the toner to adhere to a margin of paper or the like to significantly degrade the image quality.

The bulk density fluctuation of the developer may be caused by the fluctuation in the carrier charge. That is, when the carrier charge is low, electrostatic repulsive force between carrier particles is reduced. Hence, particles of the developer are tightly packed to increase the bulk density. On the other hand, when the carrier charge is high, electrostatic repulsive force between carrier particles is raised. Hence, the bulk density of the developer is lowered. The applicant of the present invention has indicated that the carrier charge changes based on the internal apparatus environment (humidity), a ratio of degraded toner in the developer, and temporal degradation of the carrier. That is, the applicant of the present invention has indicated that the amount of change in the bulk density may be estimated based on the apparatus internal environment (humidity), the amount of degraded toner in the developer, and the temporal degradation of the carrier.

The carrier is more susceptible to frictional charge, and the carrier charge increases as the humidity decreases. Further, the carrier and toner are more frictionally charged as the ratio of the degraded toner in the developer decreases. Hence, the carrier charge increases. Moreover, the carrier is less susceptible to frictional charge, and the carrier charge decreases as the carrier is degraded.

The ratio of the degraded toner in the developer may be obtained based on an image area ratio per unit travel distance of the developing roller or the transfer screw. The lower image area ratio per unit travel distance indicates lower consumption of toner, requiring less toner replacement. Thus, when the image area ratio per unit travel distance is low, the ratio of the degraded toner in the developer is high. In addition, the ratio of the degraded toner in the developer may be obtained based on the image area ratio per page. Further, the ratio of the degraded toner in the developer may be obtained based on the image area ratio per unit travel distance of the developing roller or the transfer screw and the image area ratio per page.

The temporal degradation of the carrier may be obtained by the travel distance of the developing roller 10*a*, the transfer screws 12*b* and 12*c*, a total drive time of the developing device, or the like.

In the present embodiment, the fluctuation amount in the bulk density "Δ bulk" of the current developer with respect to the bulk density of the initially used developer (the initial developer) is calculated based on the apparatus internal environment (humidity), the ratio of the degraded toner in the developer, and the temporal degradation of the carrier. Then, the output value Vt of the toner density sensor 124 is corrected based on the calculated Δ (bulk).

The fluctuation amount in the bulk density "Δ bulk" of the current developer with respect to the bulk density of the initial developer is obtained by the following formula (2).

$$\Delta\text{bulk}(\Delta AH, R, Co) = f(\Delta AH) + g(\Delta AH, R, Co) \quad (2)$$

ΔAH [g/m$^3$]: Difference between the initial absolute humidity (when the initial developer is introduced) and the current humidity (when the current developer is used)

R [km]: Total travel distance of the developing roller or transfer screw from a time at which the initial developer is introduced to a current time Co[%]: Accumulation of the image area ratios from a time at which the initial developer is introduced to a current time The travel distance R[km] of the developing roller 12*a* or each of the transfer screws is calculated as follows.

$$R = \text{Total drive time of developing device} \times \text{linear speed of transfer screw, or linear speed of developing roller}$$

The total drive time of the developing device may be obtained by measuring a time at which a drive motor for driving the developing roller is turned ON, and stopping measuring the time at which the drive motor is turned OFF.

As the above f(ΔAH), the following formula (3) may be established as one example.

$$f(\Delta AH) = \gamma \times \Delta AH \quad (3)$$

$$= \gamma \times (\text{current absolute humidity(current developer)} - \text{initial absolute humidity(initial developer)})$$

γ: Conversion coefficient

The above formula is merely an example, and may employ a non-linear speed according to the developer or system to be applied.

Further, g(ΔAH, R, Co) may be calculated by the following Tables 1 and 2, for example. Table 1 illustrates an example of a table for calculating the above g when the current humidity is less than 15 g/m$^3$, and Table 2 illustrates an example of a table for calculating the above g when the current humidity is 15 g/m$^3$ or more.

TABLE 1

| AH < 15 | Co/R < 5 | 5 ≤ Co/R < 20 | 20 ≤ Co/R |
|---|---|---|---|
| 0 ≤ R < 10 | 0.0 | 0.0 | 0.0 |
| 10 ≤ R < 20 | 3.2 | 6.4 | 9.7 |
| 20 ≤ R < 30 | 5.9 | 11.8 | 17.6 |
| 30 ≤ R < 40 | 7.9 | 15.7 | 23.6 |
| 40 ≤ R < 50 | 9.3 | 18.5 | 27.8 |
| 50 ≤ R < 60 | 10.3 | 20.6 | 30.9 |
| 60 ≤ R < 70 | 11.1 | 22.1 | 33.2 |
| 70 ≤ R < 80 | 11.7 | 23.3 | 35.0 |
| 80 ≤ R < 90 | 12.1 | 24.2 | 36.4 |
| 90 ≤ R < 100 | 12.5 | 25.0 | 37.5 |
| 100 ≤ R | 12.8 | 25.6 | 38.4 |

TABLE 2

| 15 ≤ AH | Co/R < 5 | 5 ≤ Co/R < 20 | 20 ≤ Co/R |
|---|---|---|---|
| 0 ≤ R < 10 | 0.0 | 0.0 | 0.0 |
| 10 ≤ R < 20 | 4.8 | 9.7 | 14.5 |
| 20 ≤ R < 30 | 8.8 | 17.6 | 26.5 |
| 30 ≤ R < 40 | 11.8 | 23.6 | 35.3 |
| 40 ≤ R < 50 | 13.9 | 27.8 | 41.7 |
| 50 ≤ R < 60 | 15.5 | 30.9 | 46.4 |
| 60 ≤ R < 70 | 16.6 | 33.2 | 49.8 |
| 70 ≤ R < 80 | 17.5 | 35.0 | 52.5 |
| 80 ≤ R < 90 | 18.2 | 36.4 | 54.5 |
| 90 ≤ R < 100 | 18.7 | 37.5 | 56.2 |
| 100 ≤ R | 19.2 | 38.4 | 57.6 |

As may be clear from the above tables 1 and 2, the above g is calculated based on the current absolute humidity AH, the image area ratio (R/Co) per unit travel distance of the developing roller 12*a*, or the transfer screw 12*b* or 12*c*, and the travel distance R of the developing roller 12*a*, or the transfer screw 12*b* or 12*c*.

As described above, when the bulk density fluctuation "Δ bulk" of the developer with respect to that of the initial developer is calculated, a correction amount "Δμ" of an oscillation frequency (oscillation signal counted value) of the toner density sensor 124 is calculated based on the calculated "Δ bulk". The "Δμ (bulk)" is calculated by the following formula (4).

$$\Delta\mu(\text{bulk})=\beta\times\Delta\text{bulk} \tag{4}$$

β: conversion coefficient

Then, as illustrated in the following formula (5), the "Δμ (bulk)" calculated by the above formula (4) is multiplied by a conversion coefficient α for converting the oscillation frequency "μ" of the toner density sensor indicated by the above formula (1) into the output value "Vt" of the toner density sensor. As a result, the correction value "Δ Vt (bulk)" for correcting the output value of the toner sensor is calculated.

$$\Delta Vt(\text{bulk})=\alpha\times\Delta\mu(\text{bulk}) \tag{5}$$

The toner density output value Vt illustrated in the above formula (1) is corrected by using correction value "Δ Vt (bulk)" that is based on the fluctuation the bulk density fluctuation of the developer is represented by the following formula (6).

$$Vt=\alpha\times(\mu(\text{current value})-\mu(\text{initial value}))+Vt(\text{shift})+\Delta Vt(\text{bulk}) \tag{6}$$

Hence, as described above, even though the bulk density of the developer fluctuates by calculating the correction value "Δ Vt (bulk)" for correcting the output value "Vt" of the toner density sensor 124 based on the bulk density fluctuation "Δ bulk" of the developer to correct the output value Vt of the toner density sensor 124, it is possible to accurately detect the toner density Tc.

Hence, in the present embodiment, the controller 60 serves as a bulk density fluctuation estimating module configured to estimate bulk density fluctuation "Δ bulk" with respect to the bulk density of the new developer introduced inside the casing. Further, the controller 60 also serves as a correction value calculating module configured to calculate a correction value Δ Vt (bulk) for correcting the output value of the toner density sensor 124 based on the estimated bulk fluctuation "Δ bulk". In addition, the controller 60 serves as a correction module configured to correct the output value of a toner density detection module based on the calculated correction value.

Figure 12:
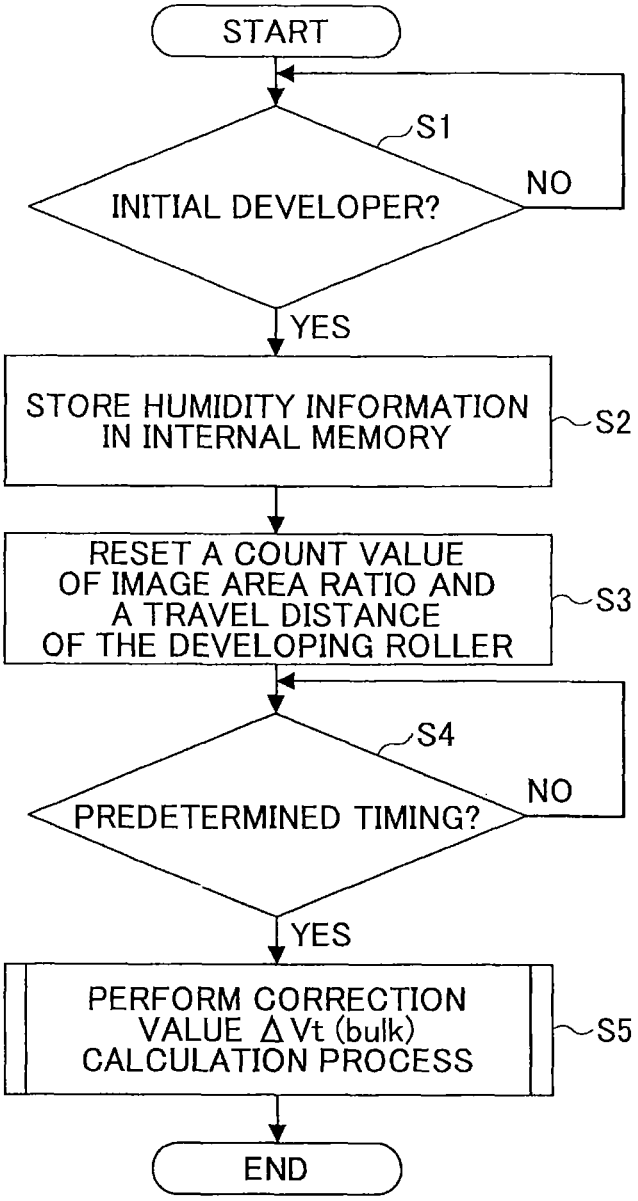
FIG. 12 is a control flow diagram illustrating a process in which bulk density fluctuation "Δ bulk" with respect to bulk density of an initial developer is calculated and a correction value for correcting the output value Vt of the toner density sensor is calculated.

FIG. 12 is a control flow diagram illustrating a process in which the bulk density fluctuation "Δ bulk" with respect to the bulk density of the initial developer is calculated and the correction value for correcting the output value Vt of the toner density sensor 124 is calculated. When the initial replacement operation mode is executed to charge the initial developer inside the developing device up to a predetermined charge level, the controller 60 computes absolute humidity [g/m$^3$] based on the temperature [° C.] and the relative humidity [% RH] detected by the temperature-humidity sensor 62. Then, the controller 60 stores the computed absolute humidity [g/m$^3$] in the internal memory 61 (YES in step S1, and S2). Further, the controller 60 resets the counted value of the image area ratio stored in the internal memory 61 and the travel distance of the developing roller (step S3).

Then, when detecting a predetermined timing (YES in step S4), the controller 60 sets a correction value calculation flag and performs a correction value Δ Vt (bulk) calculation process (step S5). Examples of the predetermined timing (i.e., the timing to set the correction value calculation flag) may be as follows.

1. Before starting image forming operation (before starting developing operation)
2. Before starting image density control
3. Predetermined timing during continuous printing (predetermined timing during continuous developing operations)
4. Temporary cessation during continuous printing (temporary cessation during continuous developing operations)

1. Before Starting Print Job

Before starting a print job, the correction value Δ Vt (bulk) is calculated, and the output value Vt of the toner density sensor 124 is corrected based on the calculated correction value Δ Vt (bulk) to adjust the toner density of the developer based on the corrected output value Vt of the toner density sensor 124. Accordingly, the image forming operations may be initiated after the toner density of the developer is adjusted reasonably well. In this case, when the controller 60 receives the image data, the controller is configured to set the correction value Δ Vt (bulk) calculation flag.

2. Before Starting Image Density Control

By calculating the correction value Δ Vt (bulk) before starting image density control, image density may be controlled based on the accurately adjusted toner density similar to the case described above. Accordingly, the image density control may be accurately conducted. In this case, the correction value Δ Vt (bulk) calculation flag is configured to be set up at the timing of conducting the image density control.

3. Predetermined Timing During Continuous Printing

The bulk density of the developer may fluctuate during continuous printing. Hence, at the predetermined timing during continuous printing (e.g., 50 sheets), the controller 60 may set the correction value Δ Vt (bulk) calculation flag to execute a correction value Δ Vt (bulk) calculation process. Accordingly, even if the bulk density fluctuates during continuous printing, the printing may be continuously conducted while maintaining the target toner density of the developer. Accordingly, it may be possible to suppress the fluctuation of the image density output by the continuous printing.

Further, the predetermined timing of calculating the correction value Δ Vt (bulk) during the continuous printing may be changed based on the environment (humidity), a non-operation time before starting continuous printing, or degradation of the carrier. For example, under the environment (a humidity condition) susceptible to the bulk density fluctuation, the predetermined timing may be quickened to raise the frequency of calculating the correction value Δ Vt (bulk), making it possible to conduct continuous printing while maintaining the target toner density of the developer. It was observed that the bulk density is susceptible to fluctuation under the environment having the absolute humidity higher than that of the standard environment (absolute humidity being 8 [g/m$^3$] or above and less than 16 g[g/m$^3$]), whereas the bulk density is not susceptible to fluctuation under the environment having the absolute humidity lower than that of the standard environment.

Hence, a non-volatile storage module such as the internal memory 61 may be configured to store a table associating a coefficient ζ by which a predetermined timing (e.g., 50 sheets) is to be multiplied with the absolute humidity AH as illustrated in Table 3. Then, the correction value Δ Vt (bulk) calculation timing may be changed based on the absolute humidity AH and the following Table 3.

TABLE 3

| | AH < 8 | 8 ≤ AH < 16 | 16 ≤ AH |
|---|---|---|---|
| ζ | 2 | 1 | 0.5 |

The controller 60 is configured to monitor a value of the temperature-humidity sensor 62. When the absolute humidity AH computed based on the temperature measured by the temperature-humidity sensor 62 and relative humidity is detected to be 8 [g/m$^3$] or above and less than 16 [g/m$^3$], the coefficient ζ=1 is set based on Table 3. Hence, when the absolute humidity AH detected is 8 [g/m$^3$] or above and less than 16 [g/m$^3$], the correction value Vt (bulk) is calculated at a predetermined timing (e.g., 50 sheets) at which the number of continuously printed sheets.

On the other hand, when the absolute humidity AH detected is less than 8 [g/m$^3$], the coefficient ζ=2 is set based on the Table 3. Hence, when the absolute humidity AH detected is less than 8 [g/m$^3$], the correction value Δ Vt (bulk) is calculated at the time at which the number of continuously printed sheets reaches twice (e.g., 100 sheets) the predetermined number of sheets (e.g., 50 sheets).

Further, when the absolute humidity AH detected is 16 [g/m$^3$] or more, the coefficient=0.5 is set based on Table 3. Accordingly, when the absolute humidity AH is 16 [g/m$^3$] or more, the correction value Vt (bulk) is calculated at the time at which the number of continuously printed sheets reaches 0.5 times (e.g., 25 sheets) the predetermined number of sheets (e.g., 50 sheets).

Hence, the predetermined timing of calculating the correction value Δ Vt (bulk) is quickened as the absolute humidity AH increases. Accordingly, it is possible to conduct continuous printing while maintaining the target toner density of the developer by increasing the frequency of calculating the correction value Δ Vt (bulk). Further, when the absolute humidity is low, a load on an operation memory may be reduced by delaying the timing of calculating the correction value.

Further, susceptibility of the bulk density fluctuation during continuous printing may vary with the non-operation time before starting continuous printing. When the non-operation time is short, the carrier is sufficiently charged at the starting time of continuous printing. Hence, during continuous printing, the carrier charge does not change much and there is merely a little change in the bulk density. On the other hand, when the non-operation time is long, the carrier charge is low at the starting time of continuous printing. Hence, during continuous printing, the carrier charge gradually rises to increase the bulk density fluctuation of the developer.

Hence, a non-volatile storage module such as the internal memory 61 may be configured to store a table associating a coefficient η by which at a predetermined number of sheets (e.g., 50 sheets) is to be multiplied for calculating the correction value Δ Vt with the non-operation time T as illustrated in Table 4. Then, the correction value Δ Vt (bulk) calculation timing may be changed based on the non-operation time T and the following Table 4.

TABLE 4

| | T < 1 | 1 ≤ T < 4 | 4 ≤ T |
|---|---|---|---|
| η | 2 | 1 | 0.5 |

When finishing the image forming operations, the controller 60 starts a timer. Subsequently, when continuous printing operations are started, the controller 60 stops the timer to detect a non-operation time T. When the non-operation time T is less than one hour, the carrier is sufficiently charged from the starting time of the continuous printing. Hence, the bulk density fluctuation is small during the continuous printing operations. Accordingly, in this case, the coefficient η=2 is set based on the Table 4. Hence, when the non-operation time T is less than one hour, the correction value Δ Vt (bulk) is calculated at the timing at which the number of continuously printed sheets reaches twice (e.g., 100 sheets) the predetermined number of sheets.

Further, when the non-operation time T is one hour is more and less than four hours, the coefficient η=1 is set based on the Table 4. Hence, when the non-operation time T is one hour is more and less than four hours, the correction value Δ Vt (bulk) is calculated at the timing at which the number of continuously printed sheets reaches the predetermined number of sheets (e.g., 50 sheets).

Moreover, when the non-operation time is four hours or more, the coefficient q=0.5 is set based on the Table 4.

Accordingly, when the non-operation time is four hours or more, the correction value Δ Vt (bulk) is calculated at the time at which the number of continuously printed sheets reaches 0.5 times (e.g., 25 sheets) the predetermined number of sheets (e.g., 50 sheets).

Hence, the predetermined timing of calculating the correction value Δ Vt (bulk) is quickened as the non-operation time increases. Accordingly, continuous printing may be conducted while maintaining the target toner density of the developer by increasing the frequency of calculating the correction value Δ Vt (bulk). Further, when the non-operation time is short, a load on an operation memory may be reduced by delaying the timing of calculating the correction value Δ Vt (bulk).

Moreover, since susceptibility of the carrier to charge varies with a degradation level of the carrier, susceptibility to the bulk density fluctuation during the continuous printing may differ. When the degradation of the carrier progresses, the bulk density of the developer may fluctuate easily. The degradation level of the carrier may be obtained based on a total drive time of the developing device, or a travel distance of the developing roller 12*a* or a travel distance of each of the transfer screws. In this embodiment, the degradation level of the carrier is obtained based on the travel distance R [km] of the developing roller 12*a* or each of the transfer screws.

In this case, similar to the above case, a non-volatile storage module such as the internal memory 61 may be configured to store a table associating a coefficient θ by which a predetermined number of sheets (e.g., 50 sheets) for calculating a predetermined correction value Δ Vt is to be multiplied with the travel distance R [km] as illustrated in Table 5. Then, the correction value Δ Vt (bulk) calculation timing may be changed based on the travel distance R and the following Table 5. The travel distance may be calculated by the following formula: R=Total drive time of the developing device×Linear speed of Transfer screw 12*b*/12*c* or Linear speed of Developing roller 12*a*, as described above.

TABLE 5

| | R < 20 | 20 ≤ R < 50 | 50 ≤ R |
|---|---|---|---|
| θ | 2 | 1 | 0.5 |

When the developer inside the developing device is an initial developer, the controller 60 resets the travel distance R and the total drive time of the developing device to measure a total drive time of the developing device 12 from 0. The total drive time of the developing device 12 may be obtained by measuring a time at which a drive motor for driving the developing roller 12*a* is turned ON, and stopping measuring the time at which the drive motor is turned OFF, as described above. The travel distance R is obtained based on the obtained total drive time and the linear speed of the transfer screw or the developing roller 12*a* stored in advance in the non-volatile storage module such as the internal memory 61. Subsequently, the obtained travel distance R being less than 20 [km] indicates that the carrier is novel, and the bulk density fluctuation during continuous printing is small. Accordingly, in this case, the coefficient θ=2 is set based on the Table 5. Hence, when the travel distance R is less than 20 [km], the correction value Δ Vt (bulk) is calculated at the time at which the number of continuously printed sheets reaches twice (e.g., 100 sheets) the predetermined number of sheets (e.g., 50 sheets).

Further, when the travel distance R is 20 [km] or more and less than 50 [km], the coefficient θ=1 is set based on the Table 5. Hence, when the travel distance R is 20 [km] or more and less than 50 [km], the correction value Δ Vt (bulk) is calculated at the timing at which the number of continuously printed sheets reaches the predetermined number of sheets (e.g., 50 sheets).

Moreover, when the travel distance R is 50 [km] or more, the coefficient θ=0.5 is set based on the Table 5. Accordingly, when the travel distance R is 50 [km] or more, the correction value Δ Vt (bulk) is calculated at the time at which the number of continuously printed sheets reaches 0.5 times (e.g., 25 sheets) the predetermined number of sheets (e.g., 50 sheets).

Hence, the predetermined timing of calculating the correction value Δ Vt (bulk) is quickened as the travel distance R increases. Accordingly, continuous printing may be conducted while maintaining the target toner density of the developer by increasing the frequency of calculating the correction value Δ Vt (bulk). Further, when the travel distance R is short, a load on the operation memory may be reduced by delaying the timing of calculating the correction value Δ Vt (bulk).

Further, the predetermined timing of calculating the correction value Δ Vt (bulk) during the continuous printing may be changed based on all the factors including the absolute humidity AH, the non-operation time T, and the travel distance R. In such a case, the correction value calculation timing is represented by the following formula.

$$\text{Correction value calculation timing} = \text{Predetermined number of sheets} \times \zeta \times \eta \times \theta$$

ζ: Correction coefficient based on the absolute humidity AH
η: Correction coefficient based on the non-operation time T
θ: Correction coefficient based on the travel distance R of the developing roller 12*a* or the transfer screw 12*b*/12*c*

The correction coefficients ζ, η and θ may be obtained based on the above-described Tables 3, 4 and 5, respectively. Examples of the tables to be used may be the above-described Tables 3, 4 and 5, or may include sections differing from those of the Tables 3, 4 and 5, or may include different values of the coefficients corresponding to the sections.

4. Temporary Image Forming Operations Cessation During Continuous Printing

The correction value calculation flag may be set at the temporary image forming operations cessation during continuous printing to execute the correction value calculation process. Load on the operation memory of the controller 60 may be smaller at the temporary image forming operations cessation than during the image forming operations. Hence, the greater operation load may be reduced by calculating the correction value Δ Vt (bulk) at the temporary image forming operations cessation during continuous printing compared to the case in which the correction value Δ Vt (bulk) is calculated during the image forming operations. Note that examples of the temporary image forming operations cessation include a toner end, service person call error generation, and deactivation of the device for lowering the internal temperature of the device.

Figure 13:
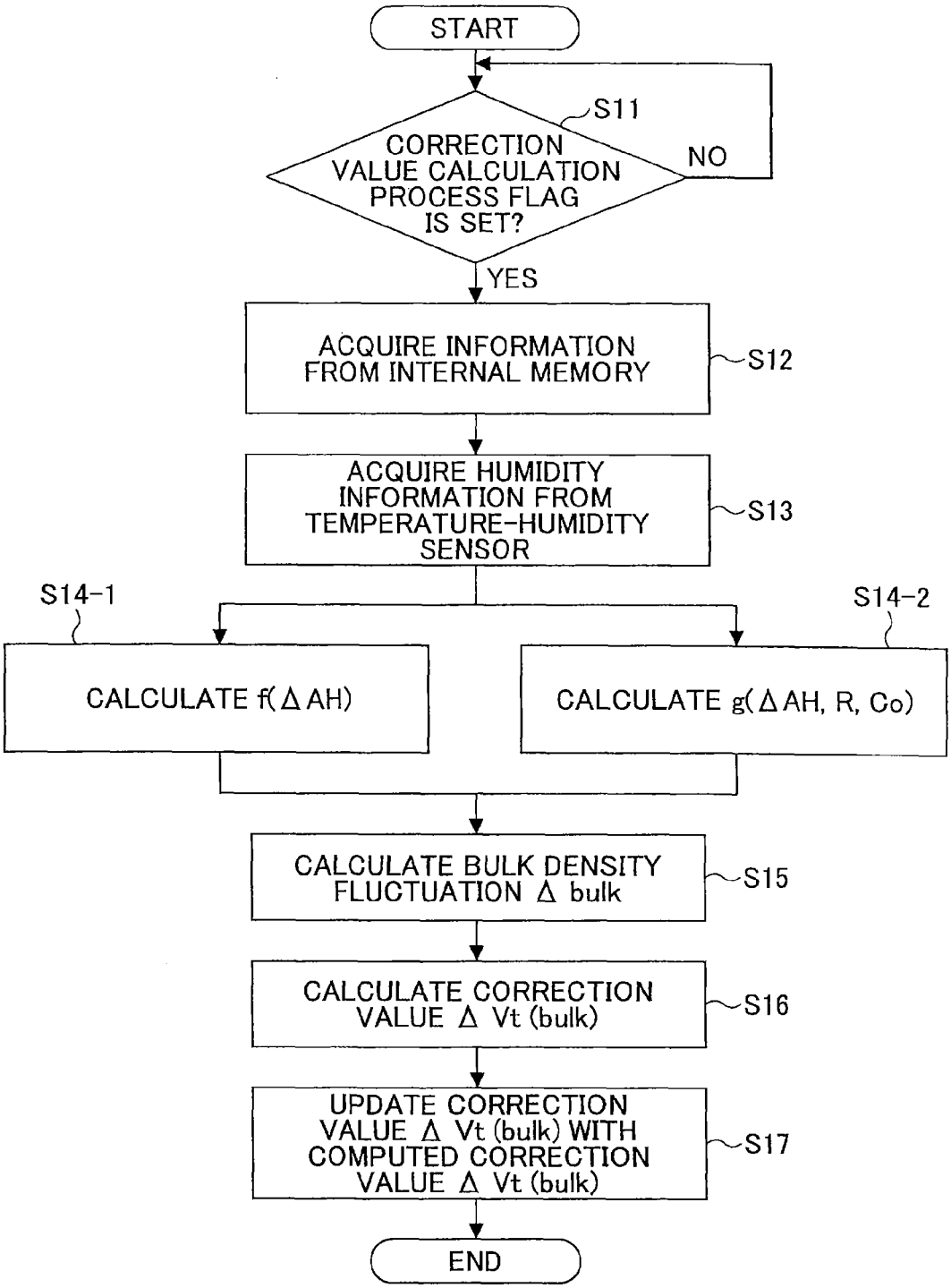
FIG. 13 is a control flow diagram of the correction value Δ Vt (bulk) calculation process.

FIG. 13 is a control flow diagram of the correction value Δ Vt (bulk) calculation process. As illustrated in 13, the controller 60 monitors whether the correction value calculation flag is set (step S11). When the correction value calculation flag is set ("YES" in step S11), the controller 60 acquires information from the internal memory 61 (step S12). The information acquired from the internal memory 61 may be as follows.

(1) The travel distance R [km] of the developing roller 12*a* or the transfer screw 12/12*c* from a time at which the initial developer is introduced to a time of development (2) The accumulated image area ratio Co from a time at which the initial developer is introduced to a time of development (3) The absolute humidity AH at a time at which initial developer is introduced Subsequently, the developer 60 computes the current absolute humidity AH based on the temperature detected by the temperature-humidity sensor 62 and a relative humidity (step S13). Next, the controller 60 calculates the f(Δ AH) indicated by the above formula (2) and g(Δ AH, R, Co), respectively (steps S14-1 and S14-2). The f(Δ AH) is calculated based on the above formula (3) using the acquired current absolute humidity AH, the absolute humidity AH at a time at which initial developer is introduced, and the conversion coefficient γ stored in the internal memory 61. In addition, for the calculation of the g(Δ AH, R, Co), initially, one of the Table 1 and Table 2 is selected based on the acquired current absolute humidity AH. Specifically, when the current absolute humidity is less than 15 [g/cm$^3$], the Table 1 is selected, whereas when the current absolute humidity is 15 [g/cm$^3$] or more, the Table 2 is selected. Subsequently, the controller 60 divides the accumulated image area ratio Co by the travel distance R of the developing roller 12*a* or the transfer screw 12*b*/12*c* obtained from a time at which the initial developer is introduced to a time of development to compute the image area ratio (Co/R) per unit travel distance. Then, the g(Δ AH, R, Co) is computed based on the selected one of the tables, the computed image area ratio (Co/R) per unit travel distance, and the travel distance R of the developing roller 12*a* or the transfer screw 12*b*/12*c* from a time at which the initial developer is introduced to a time of development.

Subsequently, the bulk density fluctuation Δ bulk is computed by adding the calculated f(Δ AH) and g(Δ AH, R, Co) (step S15). Then, the controller 60 multiplies the computed bulk density fluctuation Δ bulk by a conversion coefficient β read from the internal memory 61 to compute a correction amount Δμ (bulk) of the oscillation frequency (oscillation signal count value) of the toner density sensor 124. Next, the controller 60 multiplies the computed correction amount Δμ(bulk) of the oscillation frequency (oscillation signal count value) by a conversion coefficient α read from the internal memory 61 to calculate the correction value Δ Vt (bulk) (step S16). Then, the controller 60 updates the correction value Δ Vt (bulk) stored in the internal memory 61 with the computed correction value Δ Vt (bulk).

In the illustration above, the image area ratio per unit travel distance (Co/R) is used as the information indicating the ratio of the degraded toner in the developer; however, instead, an image area per unit travel distance may be used. The image area ratio indicates the image area ratio with respect to the sheet. Hence, the amount of toner consumed varies with the size of the sheet used even though the image area ratio is the same. The amount of toner consumed may be detected accurately by using the image area per unit travel distance, and the ratio of the degraded toner in the developer may be accurately obtained. In this case, the accumulated value of the image area from a time at which the initial developer is introduced is stored in the internal memory 61. Then, when the g(Δ AH, R, Co) is calculated, the image area per unit travel distance is computed by dividing the accumulated value of the image area by the travel distance R of the developing roller 12*a* or the transfer screw 12*b*/12*c*.

The amount of adherent toner is 1.4 to 2 times greater in a line drawing part of the image than in a solid part of the image. Hence, the image area ratio or the image area considering the ratio of the line drawing part to the solid part of the image may be accumulated to be used for the calculation of the image area (ratio) per unit travel distance (Co/R). Specifically, the above is represented by the following formula.

$$Co'=Xx\{(A/(A+B))\times 1+(B/(A+B))\times \epsilon\}$$

X: image area or image area ratio

A: ratio of solid part

B: ratio of line drawing part

ϵ: ratio of toner adhered to line drawing part with respect to toner adhered to solid part (1.4 to 2.0)

The image ratio or the image area including the ratio of the line drawing part to the solid part is accumulated, which is then used for calculating the image area (ratio) (Co'/R). Hence, it may be possible to accurately detect the amount of toner consumed. Accordingly, the ratio of the degraded toner in the developer may be accurately obtained.

Further, in the above illustration, the correction value Δ Vt (bulk) is calculated every time before the image forming operation (developing operation) starts. However, when the bulk density of the developer is approximately the same as the bulk density obtained at the previous calculation of the correction value Δ Vt (bulk), there is no need to calculate the correction value Δ Vt (bulk). Whether the bulk density obtained at the previous calculation of the correction value Δ Vt (bulk) is the same as the bulk density obtained at the current calculation of the correction value Δ Vt (bulk) may be determined based on the carrier charge at the calculation of the correction value. The carrier charge at the calculation of the correction value may be obtained based on (1) the carrier charge after the end of the previous image forming operation, and (2) a decrease in the carrier charge in the non-operation time.

(1) The carrier charge after the end of the previous image forming operation (developing operation) may be obtained based on the number of sheets on which an image is continuously formed in the previous image forming operation, or the image area ratio immediately before the end of the previous image forming operation. In comparing the number of sheets on which an image is continuously formed in the image forming operation being one and the number of sheets on which an image is continuously formed in the image forming operation being 100, developer stirring duration is longer when the number of sheets is 100. Hence, the carrier charge after the end of the image forming operation is higher when the number of sheets is 100. Accordingly, when the decrease in the carrier charge in the non-operation time is the same, the carrier charge may be higher when the number of sheets is 100. As a result, when the number of sheets on which an image is continuously formed is large, the carrier charge at the current calculation of the correction value Δ Vt (bulk) may be higher than the carrier charge at the previous calculation of the correction value Δ Vt (bulk). Accordingly, when the number of sheets on which an image is continuously formed is large, the correction value calculation flag is set to calculate the correction value Δ Vt (bulk).

Further, the amount of toner consumed is larger as the image area ratio immediately before the end of the previous image forming operation increases. Hence, the carrier charge immediately after the end of the image forming operation is increased since new toner having a high chargeability is supplied. Accordingly, when the image area ratio immediately before the end of the previous image forming operation is high, the carrier charge at the current calculation of the correction value Δ Vt (bulk) may be higher than the carrier charge at the previous calculation of the correction value Δ Vt (bulk). Accordingly, when the image area ratio immediately before the end of the previous image forming operation is high, the correction value calculation flag is set to calculate the correction value Δ Vt (bulk).

(2) The decrease in the carrier charge in the non-operation time may be obtained based on the non-operation time, the temperature in the non-operation time, and the humidity in the non-operation time. The decrease in the carrier charge is greater as the non-operation time increases. Accordingly, when the non-operation time is long, the carrier charge at the current calculation of the correction value Δ Vt (bulk) may be higher than the carrier charge at the previous calculation of the correction value Δ Vt (bulk). Accordingly, when the non-operation time is long, the correction value calculation flag is set to calculate the correction value Δ Vt (bulk).

The carrier is more susceptible to discharge as the temperature or the humidity in the non-operation time increases. Hence, the decrease in the carrier charge is greater. Accordingly, when the temperature or the humidity in the non-operation time is high, the carrier charge at the current calculation of the correction value Δ Vt (bulk) may be higher than the carrier charge at the previous calculation of the correction value Δ Vt (bulk). Accordingly, when the temperature or the humidity in the non-operation time is high, the correction value calculation flag is set to calculate the correction value Δ Vt (bulk).

Figure 14:
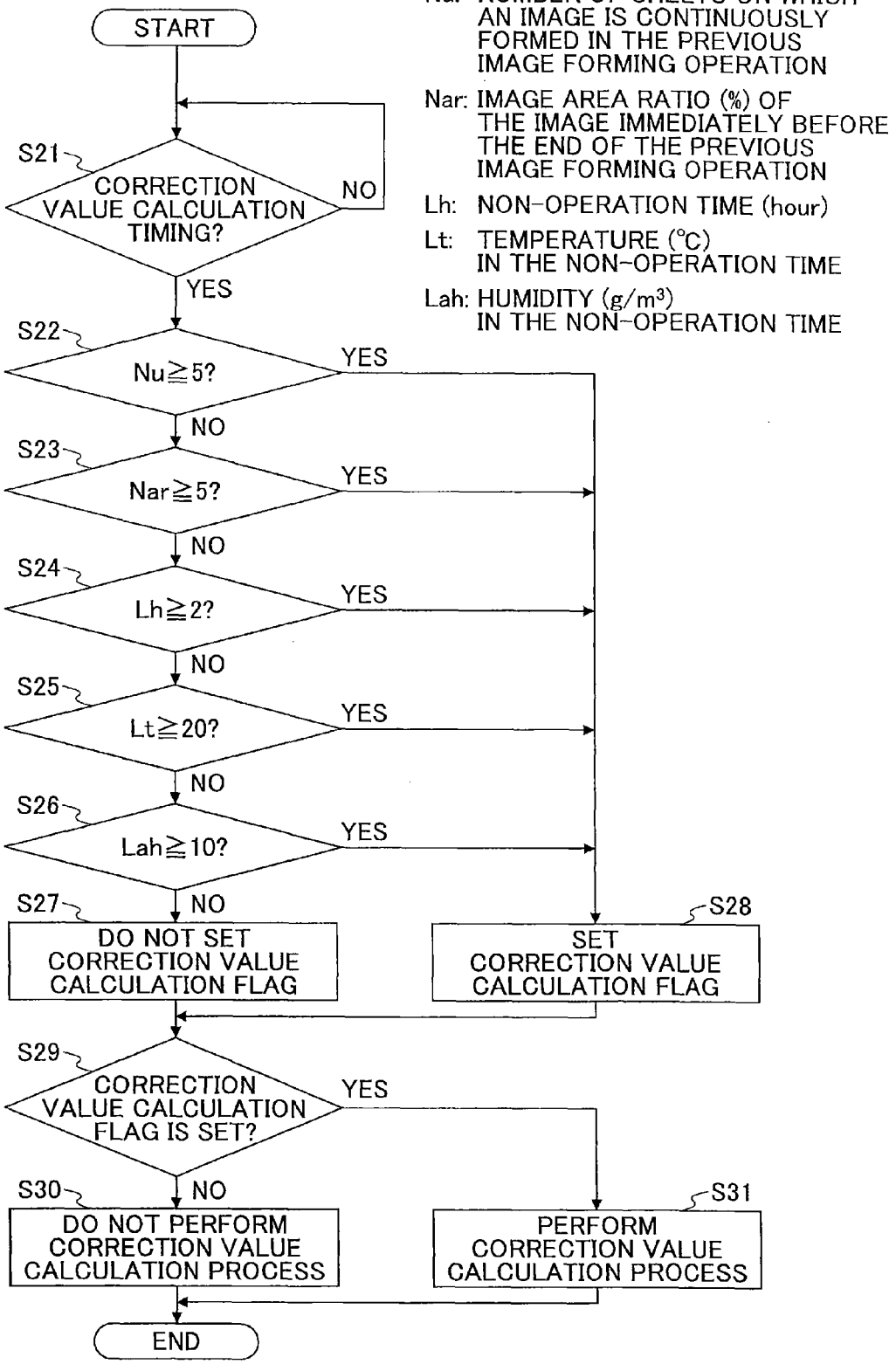
FIG. 14 is a correction value calculation determination flow diagram.

FIG. 14 is a correction value calculation determination flow diagram. In FIG. 14, Nu represents the number of sheets on which an image is continuously formed in the previous image forming operation, and Nar represents the image area ratio of the image immediately before the end of the previous image forming operation. Further, Lh represents the non-operation time (hour), Lt represents the temperature (° c.) in the non-operation time, and Lah represents the humidity (g/m$^3$) in the non-operation time.

As illustrated in FIG. 14, when the correction value calculation timing is detected (YES in step S21), it is determined whether to set the correction value calculation flag. Specifically, when any one of Nu (the number of sheets on which an image is continuously formed in the previous image forming operation), Nar (image area ratio of the image immediately before the end of the previous image forming operation), Lh (non-operation time), Lt (temperature in the non-operation time), and Lah (humidity in the non-operation time) exceeds a corresponding one of the thresholds (YES in any one of steps S22 to S26), the carrier charge may be different from that obtained at the previous correction value calculation time. Thus, the correction value calculation flag is set in this case (step S28). On the other hand, when any one of Nu (the number of sheets on which an image is continuously formed in the previous image forming operation), Nar (image area ratio of the image immediately before the end of the previous image forming operation), Lh (non-operation time), Lt (temperature in the non-operation time), and Lah (humidity in the non-operation time) is less than the corresponding threshold (NO in any one of steps S22 to S26), the carrier charge may be approximately the same as that obtained at the previous correction value calculation time. Thus, the correction value calculation flag is not set in this case (step S27).

then, when the correction value calculation flag is set (YES in step S29), the correction value calculation process is performed (step S31) as previously illustrated in FIG. 13. On the other hand, when the correction value calculation flag is not set (NO in step S29), the correction value calculation process is not performed, and the output value of the toner density sensor is corrected by using the previously calculated correction value.

As described above, when the carrier charge at the current calculation of the correction value Δ Vt (bulk) is approximately the same as that obtained at the previous calculation of the correction value Δ Vt (bulk), and the bulk density obtained at the current calculation of the correction value Δ Vt (bulk) is approximately the same as the bulk density obtained at the previous calculation of the correction value Δ Vt (bulk), the correction value is not calculated. Hence, the operation load may be reduced.

Further, in this embodiment, the collected toner collected by the cleaning device 14 is transferred to the developing device 12 where the transferred collected toner is reused. This collected toner has chargeability or flowability differing from that of the ordinary toner due to receiving the stress in the process of being transferred from the cleaning device to the developing device. Accordingly, the collected toner may be a factor for the bulk density fluctuation of the developer. Further, the collected toner is mixed with paper powder, which may also be a factor for the bulk density fluctuation of the developer. Hence, when a ratio of the collected toner in the developer is high, the calculated correction value Δ Vt (bulk) may no longer be accurate. As a result, when the output value of the toner density sensor is corrected based on the calculated correction value Δ Vt, the detected result of the toner density sensor may deviate from the actual toner density. Hence, when the ratio of the collected toner in the developer is high, it is preferable not to calculate the correction value Δ Vt.

The ratio of the collected toner in the developer may be estimated based on the absolute humidity AH and the image area ratio per unit travel distance Co/R. The transfer ratio is degraded as the absolute humidity increases, the amount of the collected toner transferred to the developing device 12 is increased, and the ratio of the collected toner in the developer is increased. Further, the amount of paper powder contained in the collected toner is increased as the image area ratio per unit distance is decreased. Moreover, the transfer ratio is degraded as the image area ratio per unit distance is decreased. As a result, the ratio of the collected toner containing paper power to the developer rises.

Hence, a non-volatile storage module such as the internal memory 61 may be configured to store a table associating the image area ratio per unit distance Co/R with the absolute humidity AH as illustrated in Table 6.

TABLE 6

| | AH < 4 | 4 ≤ AH < 16 | 16 ≤ AH |
|---|---|---|---|
| Co/R < 5 | 20% | 25% | 30% |
| 5 ≤ Co/R < 20 | 15% | 20% | 25% |
| 20 < Co/R | 10% | 15% | 20% |

Hence, based on the above, when the ratio of the estimated collected toner in the developer is 20% or more, the calculation of the correction value Δ Vt will not be performed.

Further, when there is provided a shutter member configured to switch between statuses of transferring the collected toner to the developing device 12 and transferring the collected toner to the waste toner bottle 41, such a status may need to be included as a factor. When the collected toner is transferred to the developing device 12, whether to calculate the correction value Δ Vt is determined based on the ratio of the estimated collected toner in the developer, as described above. However, when the collected toner is transferred to the waste toner bottle 41, the correction value Δ Vt is calculated. This is because the ratio of the collected toner in the developer is low.

The ratio of the collected toner of the developer at the time of estimating the ratio of the collected toner is not an estimated ratio. However, after the estimation of the ratio, the collected toner obtained by forming the images under the conditions in which the ratio of the collected toner is increased, such as the environment in which the absolute humidity AH is high or the image area ratio Co/R per unit travel distance is low, is sequentially transferred to the developing device. Accordingly, the image forming operations are conducted to some extent, the ratios of the collected toner in the developer converge on the estimated ratio of the collected toner in the developer.

As described above, when the ratio of the collected toner is high, the correction value Δ Vt will not be conducted. Accordingly, it may be possible to prevent the toner density, which is detected based on the output value of the toner density sensor corrected based on the calculated correction value Δ Vt, from deviating from the actual toner density.

Further, toner attached to a non-image forming area of the photoconductor 10 may be detected by an optical sensor or the like, and the ratio of the collected toner in the developer may be estimated by adding the information obtained by the optical sensor or the like. Accordingly, the accuracy in the estimation of the ratio of the collected toner in the developer may be improved. In addition, the ratio of the collected toner in the developer may be estimated by further adding a detected result obtained by an optical sensor configured to detect transfer residual toner or paper powder remaining on the photoconductor, the optical sensor being disposed between an image transfer position and a cleaning position. Accordingly, the accuracy in the estimation of the ratio of the collected toner in the developer may further be improved.

Moreover, the ratio of the collected toner in the developer may be estimated by further adding paper type information. The amount of paper powder adhered to the photoconductor and removed by a cleaning blade may vary with the types of paper. Hence, the ratio of the collected toner containing paper powder to the developer may be estimated by further adding the paper type information. Accordingly, the accuracy in the estimation of the ratio of the collected toner in the developer may further be improved.

The paper type information may be obtained by a user's paper type setting operation on an operations panel. Alternatively, the paper type information may be obtained by disposing a smoothness sensor serving as a smoothness detecting module configured to detect smoothness of the paper sheet. There is a correlation between the smoothness of paper and the amount of paper powder adhered to the photoconductor. Hence, the amount of paper powder contained in the collected toner may be accurately obtained by using the smoothness of paper as the paper type information, and the ratio of the collected toner containing paper powder to the developer may be accurately estimated.

Moreover, a paper powder detecting module configured to detect paper powder adhered to a transfer roller configured to transfer sheets of paper may further be provided. Hence, the ratio of the collected toner in the developer may be estimated by further adding the detected result of the paper powder detecting module. The amount of paper powder adhered to the transfer roller being large indicates the amount of paper powder adhered to the photoconductor being large. Hence, the amount of paper powder contained in the collected toner may be accurately obtained. Accordingly the ratio of the collected toner containing paper powder to the developer may be accurately estimated.

Moreover, when the information (the absolute humidity AH at a time at which the initial developer is introduced, the travel distance R of the developing roller or transfer screw from a time at which the initial developer is introduced to a current time, and the accumulated image area ratio Co from a time at which the initial developer is introduced) for use in the correction value calculation is stored in the internal memory 61, it is preferable to store such information in the development memory 125 (see FIG. 10) disposed in the developing device. After the developing device 12 is replaced, the controller 60 performs communications with the development memory 125 to verify whether the development memory 125 stores the absolute humidity AH at a time at which the initial developer is introduced, the travel distance R of the developing roller or transfer screw from a time at which the initial developer is introduced to a current time, and the accumulated image area ratio Co from a time at which the initial developer is introduced. When those pieces of information are stored in the development memory 125, the pieces of information are read from the development memory 125. Then, the absolute humidity AH, the travel distance R of the developing roller or transfer screw from a time at which the initial developer is introduced to a current time, and the accumulated image area ratio Co from a time at which the initial developer is introduced that are stored in the internal memory 61 are updated with those pieces of information in the development memory 125.

By performing the above-described control, even though the development device that is not new is set in the image forming apparatus, it may be possible to take over the information that is used in the bulk density calculation of the developer inside the developing device. Accordingly, it may be possible to accurately correct the output value of the toner density sensor even though the main body of the image forming apparatus is replaced. Note that in the above description, the development memory 125 is disposed in the developing device. However, a memory may be disposed in the frame of the process cartridge to store in the memory the absolute humidity AH, the travel distance R of the developing roller or transfer screw from a time at which the initial developer is introduced to a current time, and the accumulated image area ratio Co from a time at which the initial developer is introduced. In such a case, the above-described process may be performed when the process cartridge is replaced.

In the above description, the bulk density fluctuation "Δ bulk" of the bulk density of the current developer with respect to the bulk density of the initial developer is computed based on the three parameters; that is, the difference (Δ AH [g/m$^3$]) between the absolute humidity at a time at which the initial developer is introduced and the absolute humidity at a current time, the total travel distance (R [km]) of the developing roller or the transfer screw from a time at which the initial developer is introduced to a current time, and the accumulated image area ratio (Co [%]) from a time at which the initial developer is introduced to a current time. However, the bulk density fluctuation "Δ bulk" may be computed based on the following four parameters.

1. Developer stirring frequency
2. Physical properties of toner supplied to developing device
3. Physical properties of carrier
4. Developer stirring speed 1. Developer Stirring Frequency As described above, the bulk density of the developer varies with the carrier charge. The carrier particles and toner particles rub against one another to be frictionally charged. The carrier charge may be increased as the frequency of allowing the toner particles to rub against the carrier particles is increased due to an increase in the frequency of stirring the developer. In comparing the carrier charge by passing the same number of 1000 sheets through the developing device, the carrier charge obtained after passing 10 sheets per day amounting a total number of 1000 passed-thorough sheets is lower than the carrier charge obtained after passing 1000 sheets per day because the frequency of allowing toner particles to rub against the carrier particles is greater when passing 1000 sheets per day. Hence, the bulk density of the developer obtained after passing 10 sheets per day amounting 1000 passed-through sheets is lower than that of the developer obtained after passing 1000 sheets per day. Hence, the accuracy in the calculation of the bulk density fluctuation "Δ bulk" may be improved by adding the parameter of the frequency of stirring the developer (hereinafter also called "developer stirring frequency").

The developer stirring frequency may be estimated based on the travel distance of the developing roller per unit time. That is, when the travel distance T1 of the developing roller per unit time is longer, more image forming operations may be performed within a predetermined period. Hence, it is estimated that the developer stirring frequency is high. Further, the developer stirring frequency may also be estimated based on the number of image formed sheets per unit time, or the travel distance of the transfer screw per unit time.

2. Physical Properties of Toner Supplied to Developing Device

Physical properties of the toner supplied to the developing device may vary with lots. When the physical properties vary, effects on the bulk density of the developer may differ. For example, when the bulk density of the toner is higher than the bulk density of the standard toner as the physical properties of toner, the bulk density of the developer is high. When the bulk density of the toner supplied to the developing device is lower than the bulk density of the standard toner, the bulk density of the developer is low. In addition, when durability performance of toner varies as the physical properties of toner, the ratio of the degraded toner in the developer may differ despite the fact that the image area ratio per unit travel distance (Co/R) is the same. Hence, the bulk density fluctuation may be different. Further, when the chargeability of toner varies, the chargeability of the carrier may differ even in the same stirring time. Hence, the bulk density of the developer may be different. Hence, the accuracy in the calculation of the bulk density fluctuation "Δ bulk" may be improved by adding the parameter of the physical properties of toner.

The physical properties information of the toner supplied to the developing device 12 may be obtained as follows. That is, an ID chip is disposed in the toner bottle 20. The ID chip serves as a storage module storing the physical properties information of toner such as the bulk density of toner inside the toner bottle. The image forming apparatus is provided with a communication module configured to perform communications with the ID chip of the toner bottle so that the image forming apparatus may perform communications with the ID chip to read the toner physical properties information stored in the ID chip, and obtain the physical properties of the toner supplied to the developing device 12. Note that the toner physical properties information read from the ID chip is stored in the internal memory 61 (FIG. 10). When the physical properties information of the toner desired to be obtained is in the same lot, part of the toner physical properties information stored in the ID chip may be obtained, and toner physical properties information measured based on the obtained part of the toner physical properties information may be used.

3. Physical Properties of Carrier

Physical properties of the carrier such as chargeability and durability performance may vary with lots similar to toner. When the chargeability of the carrier varies as the physical properties of carrier, the chargeability of the carrier may differ even in the same stirring time. Hence, the bulk density of the developer may be different. Further, when the durability performance of the carrier varies as the physical properties of carrier, temporal degradation degrees of the carrier may differ even with the same travel distance R of the developing roller or the transfer screw. Hence, the bulk density fluctuation may be different. Hence, the accuracy in the calculation of the bulk density fluctuation "Δ bulk" may be improved by adding the parameter of the physical properties of carrier.

The physical properties information of the carrier may be obtained as follows. That is, the carrier physical information such as the chargeability of the carrier is stored in the development memory 125 (see FIG. 10) of the developing device, and the carrier physical information stored in the development memory 125 is read when the developing device is replaced. The obtained carrier physical information is stored in the internal memory 61. When the physical properties information of the carrier desired to be obtained is in the same lot, part of the carrier physical properties information may be obtained, and carrier physical properties information measured based on the obtained part of the carrier physical properties information may be used.

4. Developer Stirring Speed

The carrier charge rises as a speed at which the developer is stirred (hereinafter also called "developer stirring speed") increases because the toner particles and the carrier particles rub against one another. In some types of the image forming apparatuses, the image forming speed may be changed based on types of the sheets S. For example, when the sheet S is thick paper, an image is formed on the thick paper at an image forming speed lower than the image forming speed at which an image is formed on plain paper. Further, the image forming speed may be adjusted by a service person. That is, the image forming speed may be increased or decreased compared to the standard image forming speed so as to obtain a reasonable quality image. Accordingly, when the image forming speed is changed, the linear speed of the developing roller or the linear speed of the transfer screw may be changed. When the linear speed of the transfer screw is changed, the developer stirring speed may be changed. Hence, in the image forming apparatus that changes the image forming speed, the accuracy in the calculation of the bulk density fluctuation "Δ bulk" may be improved by adding the parameter of the developer stirring speed.

The developer stirring speed may be estimated by the linear speed of the transfer screw. Further, in general, since the linear speed of the developing roller corresponds to the linear speed of the transfer screw, the linear speed of the transfer screw may be indirectly obtained based on the linear speed of the developing roller.

An example of the calculation formula "Δ bulk" for including the above four parameters 1 to 4 is illustrated below. In the following example, the travel distance×[mm/sec] of the developing roller per unit time is used as the developer stirring frequency, the toner bulk density TD is used as the physical properties of toner, and the chargeability CA of the carrier is used as physical properties of the carrier. Further, the linear speed of the developing roller Vdev is used as the developer stirring speed. Note that the following calculation formula is merely an example, and is not limited to this example. The calculation formula may vary with the system or the developer employed.

$$\Delta bulk(\Delta AH, R, Co, T1, TD, CA, Vdev) = f(\Delta AH) + g(\Delta AH, R, Co, T1, TD, CA, Vdev)$$

$$g(\Delta AH, R, Co, T1, TD, CA, Vdev) = g(\Delta AH, R, Co) + g1(T1) + g2(TD) + g3(CA) + g4(Vdev)$$

$$g1(T1) = \delta \times (X - Y)$$

$$g2(TD) = \epsilon \times (TD - TD0)$$

$$g3(CA) = \zeta \times (CA - CA0)$$

$$g4(Vdev) = \eta \times (Vdev - Vdev0)$$

X[mm/sec]: travel distance of the developing roller per unit time

Y[mm/sec]: travel distance of the developing roller per expected standard unit time TD0: toner bulk density of initial developer CA0: chargeability of standard carrier Vdev0: standard linear speed δ, ϵ, ζ, η: conversion coefficients Values of the conversion coefficients δ, ϵ, ζ, and η may be computed by measuring a change in the bulk density fluctuation when values of the X, TD, CA, and Vdev are changed. Specific examples of the values the conversion coefficients δ, ϵ, ζ, and η may be as follows.

δ: 0.1

ϵ: 1.0

Λ: 1.0

η: 0.5

The values of conversion coefficients are not limited to the above described examples and may vary with a combination of toner and carrier employed or a system configuration.

The travel distance×[mm/sec] of the developing roller per unit time may be calculated by starting a count at the time of receiving the first print job of the day and updating the count every 10 minutes. Further, the travel distance×[mm/sec] of the developing roller per unit time is reset when the date is changed, or no operation is conducted for six hours or more.

Further, the toner density fluctuation TD may be measured by the method described, for example, in JIS K 5101. In addition, the chargeability CA of the carrier may be computed by measuring the toner charge after stirring the toner with the standard toner having prescribed physical properties for a predetermined time.

The toner bulk density TD0 of the initial developer is stored in the development memory 125, and is acquired by reading the toner bulk density TD0 of the initial developer stored in the development memory 125 when the developing device 12 is replaced. The acquired toner bulk density TD0 of the initial developer is stored in the internal memory 61.

The chargeability of the standard carrier indicates the chargeability of the carrier employed for calculating the above Tables 1 and 2, and the conversion coefficients δ, ϵ, ζ, and η. The standard linear speed indicates the linear speed of the developing roller employed for calculating the above Tables 1 and 2, and the conversion coefficients δ, ϵ, ζ, and η.

Further, durability performance of the toner, the chargeability of the toner and the like may be added as the physical properties information of the toner. In this case, the "Δ bulk" considering effects of durability performance of the toner and the chargeability of the toner may be obtained by calculating the difference between the physical properties of the toner supplied and the physical properties of the standard toner employed for the calculation of the above Table 1 or 2, and the conversion coefficients δ, ϵ, ζ, and η, and then adding the value multiplied by the predetermined conversion coefficient to the difference. Further, durability performance of the carrier may be added as the physical properties information of the carrier. Similar to the above toner case, the "Δ bulk" considering effects of durability performance of the carrier and the chargeability of the carrier may be obtained by calculating the difference between the physical properties of the carrier supplied and the physical properties of the standard carrier employed for the calculation of the above Table 1 or 2, and the conversion coefficients δ, ϵ, ζ, and η, and then adding the value multiplied by the predetermined conversion coefficient to the difference.

The illustration given above is merely an example, and the following embodiments may exhibit different effects specific to the embodiments.

First Embodiment

According to a first embodiment, a developing device includes a casing containing a two-component developer including toner and carrier; a developer bearer such as a developing roller 12*a* configured to carry the two-component developer on a surface of the developer bearer to transfer the two-component developer to a developing area facing a latent image bearer such as a photoconductor 10; a toner density sensor 124 configured to output an output value in accordance with toner density of the two-component developer inside the casing; a toner density detection module configured to detect toner density based on the output value of the toner density sensor and output characteristics that relate toner density and the output value; an acquisition module configured to acquire the output characteristics based on the output value of the toner density sensor 124 associated with a new developer inside the casing and a predetermined toner density of the new developer; a bulk density fluctuation estimating module configured to estimate bulk density fluctuation with respect to bulk density of the new developer with which bulk density of a current developer is expected to be matched; and a correction module configured to correct the output value of the toner density detection module based on the bulk density fluctuation estimated by the bulk density fluctuation estimating module. In the first embodiment, when the developer inside the casing is a new one, output characteristics (a relationship between the output value of the toner density sensor and the predetermined toner density) are acquired based on an output value of a new developer output by the toner density sensor and a predetermined toner density of the new developer determined by the toner density sensor. The new developer introduced inside the casing is adjusted at the predetermined toner density at the time of shipment from the factory. Hence, the output value of the toner density sensor at this time is an output value of the predetermined density. Further, the output characteristics are acquired after the new developer is stirred for a predetermined period at a predetermined stirring speed. Accordingly, the bulk density at the time of acquiring the output value of the output characteristics is predetermined bulk density. Hence, the output value of the toner density sensor at the time of detecting the new developer is the output value of the developer having the predetermined toner density detected at the predetermined bulk density. Accordingly, the output characteristics at the predetermined density are accurately obtained.

Then, in the first embodiment, bulk density fluctuation is estimated with respect to bulk density of the new developer. This bulk density is expected to obtained when the current developer has the predetermined density. Hence, when the toner density of the current developer is the predetermined toner density, bulk density fluctuation of the current developer is estimated with respect to the predetermined bulk density at which the output characteristics are acquired. Based on the estimated bulk density fluctuation, it is possible to acquire an effect due to the bulk density fluctuation in the output value of the current developer having the predetermined density that is detected by the toner density sensor. The effect of the output value due to the bulk density fluctuation may be the same when the current developer has toner density other than the predetermined toner density. Accordingly, it may be possible to eliminate the effect of the bulk density fluctuation of the current developer with respect to the new developer from the output value of the toner density sensor by correcting the output value of the toner density sensor that has detected the current developer using the estimated bulk density fluctuation. Hence, the output value of the toner density sensor is changed to the output value corresponding to the predetermined bulk density of the new developer. As a result, toner density may be accurately detected based on the accurately obtained output characteristics. Thus, the first embodiment may be able to detect toner density with higher accuracy. Hence, it may be possible to maintain the toner density of the current developer inside the casing at the predetermined density, which may improve development of the latent image on the photoconductor.

Second Embodiment

According to a second embodiment, the developing device according to the first embodiment further includes a temperature-humidity sensing module (composed of a temperature-humidity sensor 62 and a controller 60 in this embodiment) configured to detect humidity of the developing device. In the developing device, the bulk density fluctuation estimating module estimates the bulk density fluctuation based on humidity detected by a humidity detecting module when the acquisition module acquires the output characteristics and humidity currently detected by the humidity detecting module. The bulk density fluctuation is estimated based on humidity information AH at the use of the initial developer and the current humidity information AH. As described in the above embodiment, the carrier is more susceptible to being frictionally charged as the humidity decreases. Hence, the bulk density lowers as the carrier charge increases. Accordingly, the bulk density of the initial developer may be estimated based on the humidity information AH at the time of using the initial developer, and the current bulk density may be estimated based on the current humidity information AH. Thus, the bulk density fluctuation of the developer with respect to the initial use of the developer (initial developer) may be accurately estimated.

Third Embodiment

According to a third embodiment, in the developing device according to the first or the second embodiment, the bulk density fluctuation module is configured to estimate the bulk density fluctuation based on a degraded status of the magnetic carrier or the ratio of the degraded toner in the developer. As described in the above embodiment, the magnetic carrier is less susceptible to being charged as the magnetic carrier degrades. Hence, the bulk density is raised. Further, the carrier and toner are more frictionally and sufficiently charged as the ratio of the degraded toner in the developer decreases. Hence, the carrier charge increases, and the bulk density of the developer decreases. Accordingly, the bulk density fluctuation of the developer with respect to the initial use of the developer (initial developer) may be accurately estimated based on the degraded status of the magnetic carrier or the ratio of the degraded toner in the developer.

Fourth Embodiment

According to a fourth embodiment, in the developing device according to the third embodiment, a travel distance or a total drive time of the developer bearer such as the developing roller 12*a*, or the developer stirring member such as the transfer screw 12*b* or 12*c* configured to stir the developer inside the casing is used as the degraded status of the magnetic carrier. Further, the image area or the image area ratio per unit travel distance of the developer bearer or the developer stirring member is used as the ratio of the degraded toner in the developer. It may be possible to obtain the temporal degradation of the magnetic carrier based on the travel distance or the total drive time of the developer bearer or the developer stirring member configured to stir the developer inside the casing. Moreover, the amount of toner consumed may be obtained based on the image area or the image area ratio Co/R per unit travel distance of the developer bearer or the developer stirring member configured to stir the developer inside the casing. Hence, the amount of toner that needs to be replaced may be obtained. The amount of toner remaining with time in the developer (hereinafter also called "residual toner") increases as the amount of toner that needs to be replaced is reduced, resulting in an increase in the ratio of the degraded toner in the developer. Thus, the ratio of the degraded toner in developer may be obtained based on the image area or the image area ratio Co/R per unit travel distance of the developer bearer or the developer stirring member configured to stir the developer inside the casing.

Fifth Embodiment

According to a fifth embodiment, in the developing device according to the fourth embodiment, the image area or the image area ratio per unit travel distance of the developer bearer or the developer stirring member configured to stir the developer inside the casing that considers the ratio of the line drawing part to the solid part of the image is used as the ratio of the degraded toner in the developer. As illustrated in the above embodiments, the amount of the toner adhered to the line drawing part is 1.4 to twice greater than that of the toner adhered to the solid part. Hence, the amount of toner consumed may be more accurately obtained by utilizing the image area or the image area ratio per unit travel distance of the developer bearer or the developer stirring member configured to stir the developer inside the casing that considers the ratio of the line drawing part to the solid part of the image. Accordingly, the ratio of the degraded toner in the developer may be accurately obtained.

Sixth Embodiment

According to a sixth embodiment, in the developing device according to any one of the first to the fifth embodiments, the bulk density fluctuation estimating module estimates the bulk density fluctuation based on the frequency of stirring the developer. As illustrated in the above embodiments, the carrier charge rises as the frequency of stirring the developer is higher and the frequency of allowing the toner to rub against the carrier is higher, resulting in a decrease in the bulk density of the developer. Hence, the bulk density fluctuation with respect to the initial use of the developer (the initial developer) may be accurately estimated based on the frequency of stirring the developer.

Seventh Embodiment

According to a seventh embodiment, the developing device according to any one of the first to the sixth embodiments further includes a toner container such as the toner bottle 20 containing toner, and a toner supply module configured to supply toner inside the toner container to the casing. In such a developing device, the bulk density fluctuation estimating module estimates the bulk density fluctuation based on physical properties of the toner inside the toner container. As described in the above embodiments, when the physical properties such as the bulk density of toner, the charge capability of toner, and the durability performance of toner are different, the bulk density of the developer may differ despite the fact that a stirring condition or the environmental condition of the developer is the same. Accordingly, the bulk density fluctuation with respect to the initial use of the developer (the initial developer) may be accurately estimated based on the physical properties of the developer inside the toner container.

Eighth Embodiment

According to an eighth embodiment, In the developing device according to any one of the first to the seventh embodiments, the bulk density fluctuation estimating module estimates the bulk density fluctuation based on physical properties of the carrier. As described in the above embodiments, the bulk density of the developer may differ due to the physical properties of the carrier such as the charge capability of carrier and the durability performance of the carrier despite the fact that a stirring condition or the environmental condition of the developer is the same. Hence, the bulk density fluctuation with respect to the initial use of the developer (the initial developer) may be accurately estimated based on the physical properties of the carrier.

Ninth Embodiment

According to a ninth embodiment, the developing device according to any one of the first to the eighth embodiments estimates the bulk density fluctuation based on the speed at which the developer inside the casing is stirred (a developer stirring speed). According to these embodiments, the developer is stirred more frequently as the developer stirring speed increases. As a result, the carrier charge increases, and bulk density of the developer decreases. Hence, the bulk density fluctuation with respect to the initial use of the developer (the initial developer) may be accurately estimated based on the speed at which the developer inside the casing is stirred (the developer stirring speed).

Tenth Embodiment

According to a tenth embodiment, In the developing device according to any one of the above embodiments, the correction module includes a correction value calculation module configured to calculate a correction value for correcting the output value of the toner density sensor 124 based on the bulk density fluctuation estimated by the bulk density fluctuation module, and corrects the output value of the toner density sensor 124 based on the correction value calculated by the correction value calculation module, and the correction value calculation module calculates the correction value before starting a developing operation. According the developing device according to the tenth embodiment, calculating the correction value before starting the developing operation may enable the developing device to start the developing operation after the toner density is accurately adjusted. Hence, the developing device may be able to sufficiently develop the latent image on the latent image bearer such as the photoconductor 10.

Eleventh Embodiment

According to an eleventh embodiment, In the developing device according to any one of the first to tenth embodiments, the correction module includes a correction value calculation module configured to calculate a correction value for correcting the output value of the toner density sensor 124 based on the bulk density fluctuation estimated by the bulk density fluctuation module, and corrects the output value of the toner density sensor 124 based on the correction value calculated by the correction value calculation module. The correction value calculation module calculates the correction value at a timing during continuous developing operations of continuously developing the latent images on the latent image bearer such as the photoconductor 10. According to the eleventh embodiment, even if the bulk density fluctuates during continuous developing operations, the continuous developing operations may be conducted while maintaining the target toner density of the developer. Thus, it may be possible to maintain the image densities of the images obtained by the continuous developing operations at a predetermined level.

Twelfth Embodiment

According to a twelfth embodiment, in the developing device according to the eleventh embodiment, the timing at which the correction value calculation module calculates the correction value during the continuous developing operations is determined based on the environment during the continuous developing operations or the non-operations time before the continuous developing operations. As illustrated in the above embodiments, the bulk density fluctuation may vary with the environment. In addition, when the non-operation time is long, the carrier charge may be small. Hence, the carrier charge is gradually increased during the continuous developing operations, which may cause the bulk density to fluctuate during the continuous developing operations. Accordingly, the timing at which the correction value is calculated is determined based on the environment during the continuous developing operations or the non-operations time before the continuous developing operations. As a result, the correction value may be calculated at the appropriate timing so as to obtain the correction value corresponding to the bulk density of the developer. Accordingly, the continuous developing operations may be conducted while maintaining the toner density of the developer during the continuous developing operations at the target toner density.

Thirteenth Embodiment

According to a thirteenth embodiment, in the developing device according to any one of the first to tenth embodiments, the correction module includes a correction value calculation module configured to calculate a correction value for correcting the output value of the toner density sensor 124 based on the bulk density fluctuation estimated by the bulk density fluctuation module, and corrects the output value of the toner density sensor 124 based on the correction value calculated by the correction value calculation module. The correction value calculation module calculates the correction value at temporary cessation of continuously developing the latent images on the latent image bearer such as the photoconductor 10 during continuous developing operations. The developing device according to the thirteenth embodiment may be able to reduce the load on the operation memory compared to a case where the correction value is calculated during the continuous developing operations.

Fourteenth Embodiment

According to a fourteenth embodiment, in the developing device according to any one of the first to the thirteenth embodiment, the correction module includes a correction value calculation module configured to calculate a correction value for correcting the output value of the toner density sensor based on the bulk density fluctuation estimated by the bulk density fluctuation module, and corrects the output value of the toner density sensor based on the correction value calculated by the correction value calculation module. When the fluctuation in the current carrier charge with respect to the carrier charge obtained at the timing at which the correction value calculation module calculates the previous correction value is estimated as being less than a threshold, the correction module cancels the calculation of the correction value. In the developing device according to the fourteenth embodiment, when the carrier charge is not much changed with respect to the carrier charge at the time at which the previous correction value is calculated, the bulk density of the developer is approximately the same as that of the developer at the time at which the previous correction value is calculated. Hence, the toner density may be accurately maintained at the target value even though the previous correction value is used. Accordingly, when the fluctuation in the current carrier charge with respect to the carrier charge obtained at the timing at which the correction value calculation module calculates the previous correction value is estimated as being less than the threshold, the development is performed while reducing the load on the operation memory and maintaining the target toner density by cancelling the calculation of the correction value.

Fifteenth Embodiment

According to a fifteenth embodiment, in the developing device according to the fourteenth embodiment, the timing at which the correction value calculation module calculates the correction value is before the developing device starts the developing operation, and the fluctuation in the current carrier charge with respect to the carrier charge at the timing at which the previous correction value is calculated is estimated based on the estimate carrier charge at the end of the previous developing operation and the estimated reduced carrier charge from the end of the developing operation to a current time. In the developing device according to the fifteenth embodiment, the carrier charge before starting the developing operation at a timing at which the correction value is calculated is estimated based on the estimated carrier charge at the end of the previous developing operation and the estimated reduced carrier charge during non-operation time. Accordingly, the fluctuation in the current carrier charge may be accurately estimated with respect to the carrier charge at the timing at which the previous correction value is calculated.

Sixteenth Embodiment

According to a sixteenth embodiment, in the developing device according to the fifteenth embodiment, the estimated carrier charge at the end of the previous developing operation is obtained based on the number of continuous developing operations of the previous developing operation or the image area ratio immediately before the end of the previous developing operation. As illustrated in the above embodiments, the carrier particles and the toner particles rub against one another to be frictionally charged as the number of continuous developing operations of the previous developing operation increases. Hence, the magnetic carrier charge at the end of the previous developing operation is increased. Further, new toner having high charge capability is supplied as the image area ratio immediately before the end of the previous developing operation is higher. Hence, the carrier charge at the end of the previous developing operation is increased. Accordingly, the carrier charge at the end of the previous developing operation may be estimated based on the number of continuous developing operations of the previous developing operation or the image area ratio immediately before the end of the previous developing operation.

Seventeenth Embodiment

According to a seventeenth embodiment, in the developing device according to the fifteenth or the sixteenth embodiment, the estimated reduced carrier charge in the non-operation time may be estimated at least based on one of the non-operation time, the temperature and the humidity in the non-operation time. As illustrated in the above embodiments, the carrier is more discharged as the non-operation time increases. Hence, the reduced carrier charge may be greater. Further, the carrier is more susceptible to discharge as the temperature or the humidity in the non-operation time increases. Hence, the decrease in the carrier charge is greater. Accordingly, the estimated reduced carrier charge in the non-operation time may be estimated at least based on one of the non-operation time, the temperature and the humidity in the non-operation time.

Eighteenth Embodiment

According to an eighteenth embodiment, an image forming apparatus according to an eighteenth embodiment includes a latent image bearer such as the photoconductor 10 configured to carry the latent image, and a developing module such as the developing device 12 configured to develop the latent image on the latent image bearer, where the developing device according to any one of the first to the seventeenth embodiments is used the developing module.

The image forming apparatus according to the eighteenth embodiment may be able to maintain the image density at the predetermined density (the predetermined level) to obtain a satisfactory image.

Nineteenth Embodiment

According to a nineteenth embodiment, the image forming apparatus according to the eighteenth embodiment includes a storage module such as the development memory 125 configured to store the information used for estimating the bulk density fluctuation (the absolute humidity at the use of the initial developer, the accumulated image area (ratio) from the use of the initial developer to the use of the current developer, and a travel distance of the developing roller 12*a* or the transfer screw 12*b* or 12*c* from the use of the initial developer to the use of the current developer in this embodiment), and a controlling module such as a controller 60 configured to control the storage module such as the internal memory 61 to store the information for estimating the above bulk density fluctuation stored in the storage module such as the development memory 125 into the storage module such as the internal memory 61 when the developing device 12 is replaced. In the image forming apparatus according to the nineteenth embodiment, when the development device that is not new is set in the image forming apparatus, it may be possible to take over the information that is used in the bulk density estimation of the developer inside the developing device. Accordingly, it may be possible to accurately correct the output value of the toner density sensor even though the main body of the image forming apparatus is replaced.

Twentieth Embodiment

According to a twentieth embodiment, a process cartridge 1 according to a twentieth embodiment is detachably disposed with respect to the main body of the image forming apparatus that includes a latent image bearer such as the photoconductor 10 configured to carry the latent image, and a developing module such as the developing device 12 configured to develop the latent image on the latent image bearer, where the latent image bearer and the developing module are integrally supported as a unit by a common supporter with the image forming apparatus. In the process cartridge according to the twentieth embodiment, the developing device as described in any one of the first to the nineteenth embodiments is used the developing module.

The process cartridge according to the twentieth embodiment may be able to maintain the image density at the predetermined density (the predetermined level) to obtain a satisfactory image.

According to the above-described embodiments, the toner density of the developer inside the casing may be accurately detected, and the toner density of the developer inside the casing may be maintained at the predetermined density.

The present invention is not limited to the specifically disclosed embodiments, and variations and modifications may be made without departing from the scope of the present invention.

The present application is based on and claims the benefit of priority of Japanese Priority Application No. 2014-117047 filed on Jun. 5, 2014, and Japanese Priority Application No. 2014-247834 filed on Dec. 8, 2014, the entire contents of which are hereby incorporated herein by reference.

What is claimed is:

1. A developing device comprising:

a casing containing a two-component developer including toner and carrier;

a developer bearer configured to carry the two-component developer on a surface of the developer bearer to transfer the two-component developer to a developing area facing a latent image bearer;

a toner density sensor circuit configured to output an output value in accordance with toner density of the two-component developer inside the casing; and circuitry configured to:

detect the toner density based on the output value of the toner density sensor circuit and output characteristics that relate the toner density and the output value;

acquire the output characteristics based on the output value of the toner density sensor circuit associated with a new developer inside the casing and a predetermined toner density of the new developer;

estimate bulk density fluctuation with respect to bulk density of the new developer, the bulk density being expected to be obtained when a current developer has the predetermined toner density; and correct the output value based on the bulk density fluctuation, wherein the circuitry is configured to calculate a correction value for correcting the output value of the toner density sensor circuit based on the bulk density fluctuation, corrects the output value of the toner density sensor circuit based on the correction value, the circuitry is configured to estimate whether a current carrier charge at a timing at which the correction value is calculated differs from a carrier charge at a timing at which a previous correction value is calculated, and when the fluctuation in the current carrier charge with respect to the carrier charge obtained at the timing of the previous correction value is estimated as being less than a threshold, the circuitry is configured to cancel the calculation of the correction value.

2. The developing device as claimed in claim 1, wherein the circuitry is configured to detect humidity of the developing device, and wherein the circuitry is configured to estimate the bulk density fluctuation based on the detected humidity when the output characteristics are acquired and currently detected humidity.

3. The developing device as claimed in claim 1, wherein the circuitry is configured to estimate the bulk density fluctuation based on a degraded status of the carrier or a ratio of degraded toner in the developer.

4. The developing device as claimed in claim 3, wherein a travel distance or a total drive time of the developer bearer or a developer stirring member configured to stir the developer inside the casing is used as the degraded status of the carrier, and wherein an image area or an image area ratio of the developer bearer or the developer stirring member per unit travel distance is used as the ratio of the degraded toner in the developer.

5. The developing device as claimed in claim 4, wherein the image area or the image area ratio of the developer bearer or the developer stirring member per unit travel distance considering a ratio of a line drawing part to a solid part of an image is used as the ratio of the degraded toner in the developer.

6. The developing device as claimed in claim 1, further comprising:

a toner container configured to contain the toner, wherein the circuitry is configured to supply toner inside the toner container to the casing, and wherein the circuitry is configured to estimate the bulk density fluctuation based on physical properties of the toner inside the toner container.

7. The developing device as claimed in claim 1, wherein the circuitry is configured to estimate the bulk density fluctuation based on physical properties of the carrier.

8. The developing device as claimed in claim 1, wherein the circuitry is configured to estimate the bulk density fluctuation based on a stirring speed of the developer inside the casing.

9. The developing device as claimed in claim 1, wherein the circuitry is configured to calculate the correction value before starting a developing operation.

10. The developing device as claimed in claim 1, wherein the circuitry is configured to calculate the correction value at a predetermined timing during continuous developing operations to develop a latent image on the latent image bearer.

11. The developing device as claimed in claim 10, wherein the predetermined timing at which the correction value is calculated during continuous developing operations is determined based on environment during the continuous developing operations or a non-operation time before the continuous developing operations.

12. The developing device as claimed in claim 1, wherein the circuitry is configured to calculate the correction value at temporary cessation of developing latent images on the latent image bearer during continuous developing operations.

13. The developing device as claimed in claim 1, wherein a timing at which the correction value is before starting a developing operation, and the circuitry is configured to estimate fluctuation in the current carrier charge with respect to the carrier charge at the timing at which the previous correction value is calculated based on an estimated carrier charge at an end of a previous developing operation and an estimated reduced carrier charge at a non-operation time.

14. The developing device as claimed in claim 13, wherein a number of continuous developing operations of the previous developing operation or an image area ratio immediately before the end of the previous developing operation is used as information associated with the estimated carrier charge at the end of the previous developing operation.

15. The developing device as claimed in claim 13, wherein at least one of the non-operation time, a temperature during the non-operation time, and humidity during the non-operation time is used as the estimated reduced carrier charge at the non-operation time.

16. An image forming apparatus comprising:

a latent image bearer configured to carry a latent image; and the developing device according to claim 1.

17. The developing device as claimed in claim 1, wherein the circuitry is configured to estimate the bulk density fluctuation based on a stirring frequency of the developer.

18. A method for estimating toner density in a developing device, the developing device including a casing containing a two-component developer including toner and carrier, a developer bearer configured to carry the two-component developer on a surface of the developer bearer to transfer the two-component developer to a developing area facing a latent image bearer, a toner density sensor circuit configured to output an output value in accordance with toner density of the two-component developer inside the casing, and circuitry configured to detect the toner density based on the output value of the toner density sensor circuit and output characteristics that relate the toner density and the output value, the method comprising:

acquiring the output characteristics based on an output value of the toner density sensor circuit associated with a new developer inside the casing and a predetermined toner density of the new developer;

estimating bulk density fluctuation with respect to bulk density of the new developer with which bulk density of a current developer is expected to be matched;

correcting the output value of the toner density sensor circuit based on the bulk density fluctuation, calculating a correction value for correcting the output value of the toner density sensor circuit based on the bulk density fluctuation, correcting the output value of the toner density sensor circuit based on the correction value, estimating whether a current carrier charge at a timing at which the correction value is calculated differs from a carrier charge at a timing at which a previous correction value is calculated, and canceling the calculation of the correction value when the fluctuation in the current carrier charge with respect to the carrier charge obtained at the timing of the previous correction value is estimated as being less than a threshold.

* * * * *